US009771195B2

(12) United States Patent
Lawson et al.

(10) Patent No.: US 9,771,195 B2
(45) Date of Patent: Sep. 26, 2017

(54) DRINKING VESSELS INCLUDING DEVICES FOR PROVIDING A MIXED LIQUID THEREFROM

(71) Applicant: Tervis Tumbler Company, North Venice, FL (US)

(72) Inventors: Mark Griswold Lawson, Sarasota, FL (US); Erik Steven Brown, Sarasota, FL (US)

(73) Assignee: Tervis Tumbler Company, North Venice, FL (US)

( * ) Notice: Subject to any disclaimer, the term of this patent is extended or adjusted under 35 U.S.C. 154(b) by 0 days.

(21) Appl. No.: 15/499,979

(22) Filed: Apr. 28, 2017

(65) Prior Publication Data

US 2017/0225855 A1 Aug. 10, 2017

Related U.S. Application Data

(63) Continuation of application No. 14/926,315, filed on Oct. 29, 2015, now Pat. No. 9,650,189.

(51) Int. Cl.

| | |
|---|---|
| ***B65D 51/28*** | (2006.01) |
| ***A47G 19/22*** | (2006.01) |
| ***B65D 47/06*** | (2006.01) |
| ***B65D 47/12*** | (2006.01) |
| ***B65D 47/32*** | (2006.01) |
| ***A47G 21/18*** | (2006.01) |

(52) U.S. Cl.

CPC ..... *B65D 51/2807* (2013.01); *A47G 19/2272* (2013.01); *A47G 21/18* (2013.01); *B65D 47/065* (2013.01); *B65D 47/12* (2013.01); *B65D 47/32* (2013.01)

(58) Field of Classification Search

CPC .. B65D 51/2807; B65D 47/065; B65D 47/12; B65D 47/32; A47G 19/2272; A47G 21/18

USPC ..... 220/703, 705, 707, 708, 711, 713, 714, 220/715; 215/229, 387, 388; 222/484, 222/494, 531, 212, 534, 556, 481.5; 137/846

See application file for complete search history.

(56) References Cited

U.S. PATENT DOCUMENTS

| | | | | |
|---|---|---|---|---|
| 5,065,909 | A | 11/1991 | Pino et al. | |
| 5,477,994 | A | 12/1995 | Feer et al. | |
| 5,615,809 | A | 4/1997 | Feer et al. | |
| D408,623 | S * | 4/1999 | Shaanan | D3/202 |
| 6,372,270 | B1 | 4/2002 | Denny | |

(Continued)

*Primary Examiner* — Kareen Thomas
(74) *Attorney, Agent, or Firm* — Caesar Rivise, PC

(57) ABSTRACT

Disclosed are lid assemblies for use on a vessel holding a base liquid. They include an agent chamber for holding a liquid agent and a pivotable spout. The spout includes a base liquid inlet port and a liquid agent inlet port, respective passageways connected to those ports and terminating at a mixing space. The agent chamber includes plural different sized metering orifices, orifice configured to be brought into communication with the liquid agent port of the spout when the spout is pivoted to any one of plural angular positions to provide a metered amount of the liquid agent into the spout for mixing with the base liquid in the mixing space when the user sucks on the spout. The base liquid is drawn into the spout from the interior of the vessel via a base liquid metering port that is brought into communication with the base liquid inlet port when the spout is in any one of those plural angular positions.

20 Claims, 29 Drawing Sheets

(56) References Cited

U.S. PATENT DOCUMENTS

| | | | | |
|---|---|---|---|---|
| 6,523,711 | B1 * | 2/2003 | Hughes | A47G 19/2266 215/308 |
| 7,172,095 | B2 | 2/2007 | Marshall | |
| 7,299,936 | B2 | 11/2007 | Singh et al. | |
| 8,167,174 | B2 | 5/2012 | Berger | |
| 8,191,727 | B2 | 6/2012 | Davies et al. | |
| 8,230,777 | B2 | 7/2012 | Anson et al. | |
| 8,413,844 | B2 | 4/2013 | Arett et al. | |
| 8,550,304 | B2 | 10/2013 | Berger | |
| 8,657,158 | B1 | 2/2014 | Snell | |
| 8,668,106 | B1 | 3/2014 | Joy et al. | |
| 8,672,174 | B1 | 3/2014 | McMullin | |
| 2003/0072850 | A1 | 4/2003 | Burniski | |
| 2006/0021996 | A1 | 2/2006 | Scott, III et al. | |
| 2010/0170902 | A1 | 7/2010 | Britto et al. | |
| 2012/0305559 | A1 | 12/2012 | Steininger | |
| 2014/0230659 | A1 | 8/2014 | Waggoner et al. | |

* cited by examiner

DRINKING VESSELS INCLUDING DEVICES FOR PROVIDING A MIXED LIQUID THEREFROM

CROSS-REFERENCE TO RELATED APPLICATION

This application is a continuation of and claims the benefit under 35 U.S.C. §120 of U.S. application Ser. No. 14/926,315, filed on Oct. 29, 2015, entitled DRINKING VESSELS INCLUDING DEVICES FOR PROVIDING A MIXED LIQUID THEREFROM. The entire contents of the foregoing application is expressly incorporated herein by reference thereto.

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

FIELD OF THE INVENTION

This invention relates generally to drinking vessels and more particularly to devices, e.g., lids, for drinking vessels or drinking vessels including such devices for mixing a liquid agent in the device with a base liquid in the vessel and delivering the mixed liquid to a user.

BACKGROUND OF THE INVENTION

Various drinking vessels for providing a beverage mixed from a base liquid and a flavoring agent have been disclosed in the patent literature. See for example: U.S. Pat. No. 6,372,270 (Denny); U.S. Pat. No. 7,172,095 (Marshall); U.S. Pat. No. 7,299,936 (Singh et al.); U.S. Pat. No. 8,230,777 (Anson et al.); U.S. Pat. No. 8,657,158 (Snell); Published Application US2003/0072850 (Burniski); Published Application US2006/0021996 (Scott III, et al.); and Published Application US2014/0230659 (Waggonner et al.). Moreover various drinking vessels for providing a mixed beverage are commercially available. Examples of such commercially available vessels are those sold by Coolgear, Inc. under the trade designations Coolgear 20 oz. Aquaburst Bottle, Coolgear 20 oz. Ledge Double Wall Bottle, Coolgear 22 oz. Horizon Bottle, and Coolgear 56 oz. Infusion Bottle. Other such vessels are sold by CamelBak Products, LLC under the trade designations CamelBak Eddy. 75 L, CamelBak Eddy.Insulated, and CamelBak Groove 0.75 L. Still other commercially available vessels are the Thermos 18 oz. Hydration Bottle, the Nalgene MultiDrink bottle and the Brita Hard-Sided Bottle.

While such prior art drinking vessels are generally suitable for their intended purposes, they nevertheless leave much to be desired from one or more of various standpoints, e.g., ability to provide repeated desired concentrations of a mixed liquid or beverage, resistance to backflow into the base liquid, ease of use, simplicity of construction, Thus a need exists for a device for use with a drinking vessel or for a drinking vessel incorporating a device which overcomes the various disadvantages or needs of the prior art. The subject invention does that.

SUMMARY OF THE INVENTION

In accordance with one aspect of this invention a device for use with a vessel in which a base liquid is located is provided. The device is configured for dispensing a portion of a liquid agent into a portion of the base liquid drawn from the vessel. The device comprises a spout, an agent chamber and a conduit. The agent chamber is configured for holding the liquid agent therein. The conduit is coupled to the agent chamber and has a free end portion configured to be located adjacent the bottom of the vessel. The spout is coupled to the agent chamber and comprises a mixing space located within the spout and has an agent inlet port and a base liquid inlet port. The agent inlet port and the base liquid inlet port are in communication with the mixing space. The agent chamber comprises a wall portion having a base liquid orifice and a first agent metering orifice therein. The spout is selectively movable with respect to the agent chamber to any one of a first position, a second position, and a third position. The base liquid inlet port is isolated from the base liquid orifice and the agent inlet port is isolated from the first agent metering orifice when the spout is in the first position. The base liquid inlet port is in communication with the conduit via the base liquid orifice and the agent inlet port is isolated from the first agent metering orifice when the spout is in the second position, whereupon base liquid from the vessel can to be drawn through the base liquid orifice and the base liquid port into the mixing space. The first agent metering orifice is in communication with the agent inlet port and the base inlet port is in communication with the conduit via the base liquid orifice when the spout is in the third position to enable a portion of the base liquid from the vessel to be drawn through the base liquid orifice and the base liquid port into the mixing space and to enable a portion of the liquid agent within the agent chamber to be drawn through the first agent metering orifice and the agent inlet port into the mixing space for mixing with the base liquid in the mixing space.

In accordance with some preferred aspects of this invention the agent chamber has a second agent metering orifice and a third metering orifice therein. The second agent metering orifice is of a different size than the first agent metering orifice. The spout is also selectively moveable with respect to the agent chamber to a fourth position. The second agent metering orifice is in communication with the agent inlet port and the base inlet port is in communication with the conduit via the base liquid orifice when the spout is in the fourth position to enable a portion of the base liquid from the vessel to be drawn through the base liquid orifice and the base liquid port into the mixing chamber and to enable a portion of the liquid agent within the agent chamber to be drawn through the second agent metering orifice and the agent inlet port into the mixing space for mixing with the base liquid in the mixing space. The third agent metering orifice is of a different size than the first and second agent metering orifices. The spout is also selectively moveable with respect to the agent chamber to a fifth position. The third metering orifice is in communication with the agent inlet port and the base inlet port is in communication with the conduit via the base liquid orifice when the spout is in the fifth position to enable a portion of the base liquid from the vessel to be drawn through the base liquid orifice and the base liquid port into the mixing chamber and to enable a portion of the liquid agent within the agent chamber to be drawn through the third agent metering orifice and the agent inlet port into the mixing space for mixing with the base liquid in the mixing space.

Another aspect of this invention entails method for dispensing either a base liquid or a mixture of a base liquid and a liquid agent into the mouth of a user from a vessel. The method comprises providing a vessel configured for holding a base liquid therein and a dispensing device is coupled to the vessel. The dispensing device has a spout, an agent chamber, a conduit, a base liquid inlet port, and an agent inlet port. The conduit is in fluid communication with the base liquid in the vessel. The agent chamber is configured for holding a liquid agent therein and comprises a first agent metering orifice in fluid communication with the liquid agent and a base liquid orifice in fluid communication with the conduit. The dispensing device is configured so that a portion thereof can be moved to any one of a first, second and third positions. The base liquid inlet port is isolated from the base liquid orifice and the agent inlet port is isolated from the first agent metering orifice when the portion of the device is in the first position. The base liquid inlet port is in communication with the conduit via the base liquid orifice and the agent inlet port is isolated from the first agent metering orifice when the portion of the device is in the second position. The first agent metering orifice is in communication with the agent inlet port and the base inlet port is in communication with the conduit via the base liquid orifice when the portion of the device is in the third position. A portion of the device is moved from the first position to either the second position or the third position. The user sucks on the spout when the device is in either the second or third position. If the device is in the second position the sucking on the spout draws a portion of the base liquid from the vessel through the base liquid orifice and the base liquid port into the mouth of the user. If the device is in the third position the sucking on the spout draws a portion of the base liquid from the vessel through the base liquid orifice and the base liquid port and also draws a portion of the liquid agent within the agent chamber through the first agent metering orifice and the agent inlet port to mix the portions together and dispense the mixture into the mouth of the user.

In accordance with one preferred aspect of the method of this invention the portion of the dispensing device that is moved is the spout, e.g., the spout can be pivoted to any one of the various positions.

DETAILED DESCRIPTION OF THE PREFERRED EMBODIMENT

Figure 1:
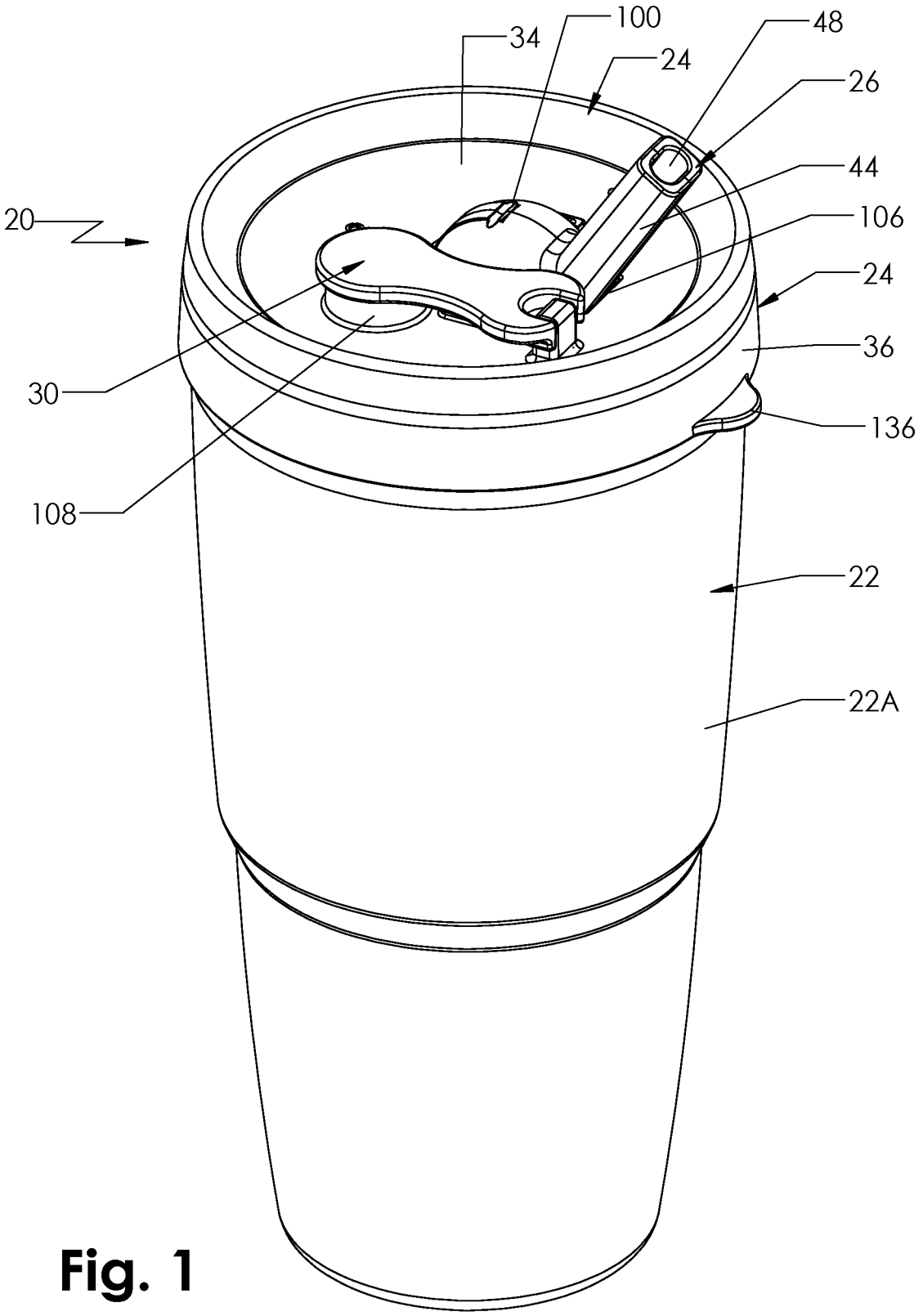
FIG. 1 is an isometric view of a first exemplary embodiment of a dispensing device or infuser in the form of lid assembly constructed in accordance with this invention shown mounted on an insulated vessel holding a base liquid, e.g., water, to enable a user to drink the base liquid alone or a mixture of the base liquid and a liquid agent, e.g., a flavoring agent, through a spout of the device, with the device being shown in its state wherein it delivers a maximum strength mixture.

Referring now to the various figures of the drawing wherein like reference characters refer to like parts, there is shown at 20 in FIG. 1 a first exemplary embodiment of an infuser or dispensing device, e.g., a lid assembly, constructed in accordance with this invention. In FIGS. 27, 30, 33, and 37 there are shown a second, third, fourth and fifth exemplary embodiments, respectively, of other lid assemblies constructed in accordance with this invention. Each of the exemplary embodiments shown and described herein is configured for releasable securement on vessel of any kind holding a base liquid, e.g., water, and includes an agent chamber for holding a liquid agent, e.g., a flavoring agent (hereinafter sometimes referred to as a "flavorant"), a vitamin/mineral supplement, or any other liquid agent desired to be mixed or infused with the base liquid for a user to drink from the device. Each liquid dispensing device includes a movable spout, to be described shortly, on which the user can suck to draw either the base liquid itself or a mixture of the base liquid and the liquid agent into the user's mouth. In fact, as will be described later, the spout is configured so that when the user sucks on it, that action draws the base liquid into the spout where it is mixed with the liquid agent in a mixing chamber or space located adjacent the free end of the spout. Moreover, the spout is movable with respect to the agent chamber to various discrete positions to enable a desired amount of the liquid agent (or no liquid agent) to be delivered to the spout for mixing with the base liquid to thereby establish a desired concentration of the mixed liquid to be delivered to the user.

The liquid agent may be in the form of a liquid which is introduced as such into the agent chamber or may be in the form of a frangible or otherwise rupturable canister or cartridge holding the liquid agent for disposition within the agent chamber and when in the chamber the canister or cartridge is ruptured to release the liquid agent into the agent chamber. In any case, once in the agent chamber the liquid agent is available to be mixed with the base liquid from the vessel to provide the user with either the base liquid alone or a mixture of the base liquid and the liquid agent. To that end, the dispensing devices are constructed so that the user can readily establish the concentration of the liquid agent in the mixture from none to a maximum concentration. In particular, in the exemplary embodiments to be described hereinafter, the user can move, e.g., pivot, the spout from a first or "closed" position, where no liquid can be drawn from it, or to any one of a second, third, fourth or fifth "open" positions where liquid is delivered to the user. In a second open position or state the spout only enables the base liquid to be drawn from it and delivered to the user when the user sucks on the spout. In the third open position or state the spout enables the liquid agent and the base liquid to be mixed within the spout in a low or minimum concentration for delivery to the user when the user sucks on the spout. In the fourth open position or state the spout enables the liquid agent and the base liquid to be mixed within the spout in a medium concentration for delivery to the user when the user sucks on the spout. In the fifth open position or state the spout enables the liquid agent and the base liquid to be mixed within the spout in a high or maximum concentration for delivery to the user when the user sucks on the spout.

Before describing the details of the construction and operation of the first exemplary lid assembly 20, a brief description of the drinking vessel 22 is in order. To that end, as shown in the exemplary embodiment of FIG. 1, the vessel for holding the base liquid is an insulated, e.g., double walled, drinking vessel 22 in the form of a tumbler that is similar in construction to those conventional 24 oz. insulated decorative tumblers sold by Tervis Tumbler, the assignee of this invention. The tumbler 22 basically comprises an assembly of a hollow outer body or vessel 22A and a hollow inner body or vessel 22B which are fixedly secured together. The outer vessel 22A is a hollow member having a sidewall which is a body of revolution extending about a central longitudinal axis. The outer vessel can be formed in any manner, e.g., it can be blow molded or injection molded of any suitable plastic material. The hollow inner vessel 22B is also a hollow member having a sidewall which is a body of revolution extending about the central longitudinal axis. The inner vessel can also be formed in any manner, e.g., it can be blow molded or injection molded of any suitable plastic material (e.g., the same plastic material as the vessel 22A or some other material).

The top portion of the sidewall of the inner vessel 22B is thickened to form the annular rim 22C of the vessel 22 and is undercut on its outer surface for engagement with the top edge of the outer vessel 22A when the inner vessel is located within the outer vessel. The inner and outer vessels are secured together by a welded, e.g., ultrasonically welded, joint at the interface where the undercut surface of the top portion 22C of the inner vessel meets the top surface of the outer vessel. With the inner vessel 22A located within the outer vessel the outer surface of the inner vessel is disposed opposite and confronting the inner surface of the outer vessel, but is spaced slightly therefrom to form an annular thermally insulating space therebetween. If desired, and if at least the outer vessel is transparent (or if the outer vessel includes a transparent window), a decorative wrap (not shown) or some other decorative item may be located within the insulating space to be visible through the outer wall or window to enhance the aesthetically pleasing appearance of the vessel. While not shown in the drawing, the outer diameter of the outer surface of the portion 22C is slightly greater than the outer diameter of the top edge of the outer vessel to create a slight undercut surface thereat. This undercut surface is arranged to be engaged by an elastomeric ring of the lid assembly to facilitate the releasable securement of the lid assembly on the vessel 22 and to form a good liquid-tight interface therebetween.

Figure 2:
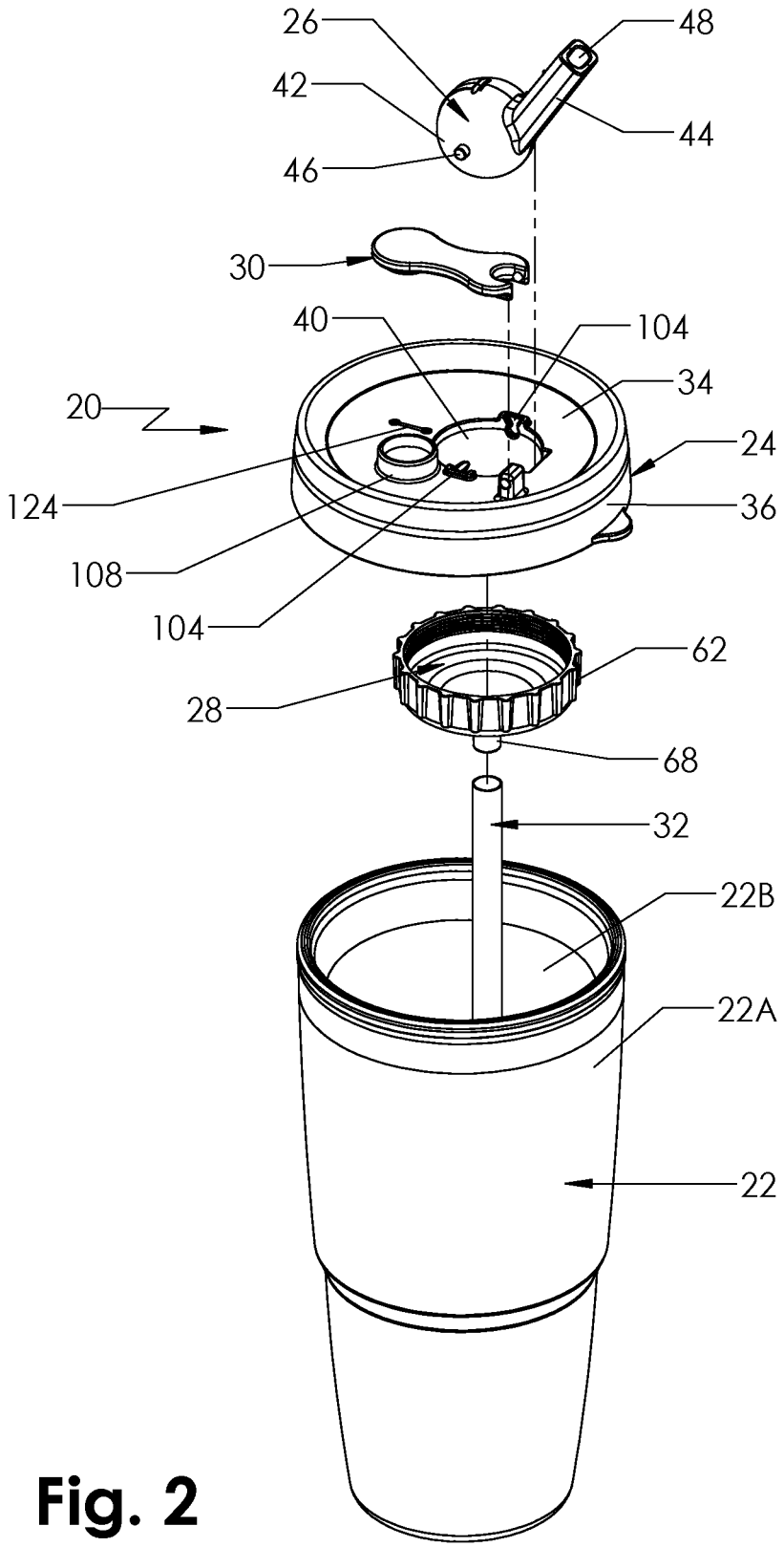
FIG. 2 is a reduced exploded isometric view of the device of FIG. 1.

Turning now to FIGS. 1 and 2, the details of the lid assembly 20 will now be described. As can be seen the lid assembly 20 basically comprises a lid 24, the heretofore mentioned spout 26, the heretofore mentioned agent chamber 28 (FIG. 2), a cap 30, and a conduit or straw 32 (FIG. 2).

Turning now to FIGS. 2, 3, 5 and 7-11, the details of the lid 24 will now be described. As can be seen it basically comprises an integral unit formed of any suitable plastic material and in the form of a top wall 34, a peripheral sidewall 36 extending about the top wall, and an annular wall 38 extending downward from the inner surface of the top wall and within the bounds of the sidewall 36 (FIGS. 5, 8 and 10) to form an annular recess 38A therebetween. The annular recess 38A is configured to receive the rim 22C of the vessel 22 when the lid assembly 20 is mounted thereon. The top wall of the lid is of circular profile and is generally planar except for a hemi-spherically shaped concave recess 40 located adjacent to the center of the lid. The portion of the top wall forming the recess 40 serves as the upper wall of the agent chamber 28 (to be described later) and also serves to pivotably receive a portion of the spout 26.

The spout is best seen in FIGS. 10 and 15-18. As can be seen it is somewhat "whistle" shaped and basically comprises a generally spherical bottom section 42 and a generally parallelepiped upper section 44. A pair of axially aligned pivot pins 46 project outward from the bottom section along a pivot axis A. The upper section 44 is ergonomically shaped so that it can be placed between the lips of a user and includes an internally located mixing chamber or space 48 (FIGS. 4, 17 and 18) at the free end 50 of the spout. The bottom section 42 of the spout includes a base liquid inlet port 52 and an agent liquid inlet port 54. The base liquid inlet port is of larger internal diameter, e.g., 0.1875 in, than the internal diameter, e.g., 0.075 in of the agent liquid inlet port. A passageway 56 interconnects the base liquid inlet port 52 to the mixing space 48. Another and discrete passageway 58 interconnects the agent liquid inlet port 54 to the mixing space 48.

The base liquid inlet port 52 is configured to cooperate with a base liquid metering orifice (to be described later) forming a portion of the agent chamber to enable a portion of the base liquid to be drawn from the vessel 22 into the spout through passageway 56 to the mixing space 48 and hence into the user's mouth when the spout is pivoted to any one of the second, third, fourth and fifth open positions or states and the user sucks on the spout. The agent liquid inlet port 54 is configured to cooperate with any one of three liquid metering orifices (to be described later) forming a portion of the agent chamber 28 to enable the liquid agent to be drawn from the agent chamber into the spout through passageway 58 to the mixing space 48 for mixing with the base liquid delivered thereto by the passageway 56 and hence into the user's mouth when the spout is in any one of the heretofore mentioned third, fourth or fifth open positions and the user sucks on the spout.

The agent chamber 28 basically comprises the heretofore identified recess portion 40, an annular wall 60, and a cup-shaped base 62. The annular wall 60 projects downward from the undersurface of the top wall 34 and surrounds the recess portion 40. The outer surface of the annular wall 60 includes an external helical thread 64. The cup-shaped base 62 is of circular profile and includes an internal helical thread 66 to screw onto the thread 64 on the annular wall 60. A tubular projection or collar 68 projects downward from the center of the cup-shaped base and serves as the means for mounting the conduit or straw 32 to it. The conduit or straw 32 is a tubular member of sufficient length such that when it is mounted on the collar 68 the free end 70 (FIG. 4) of the conduit is located close to the bottom of the interior of the vessel 22.

Figure 11:
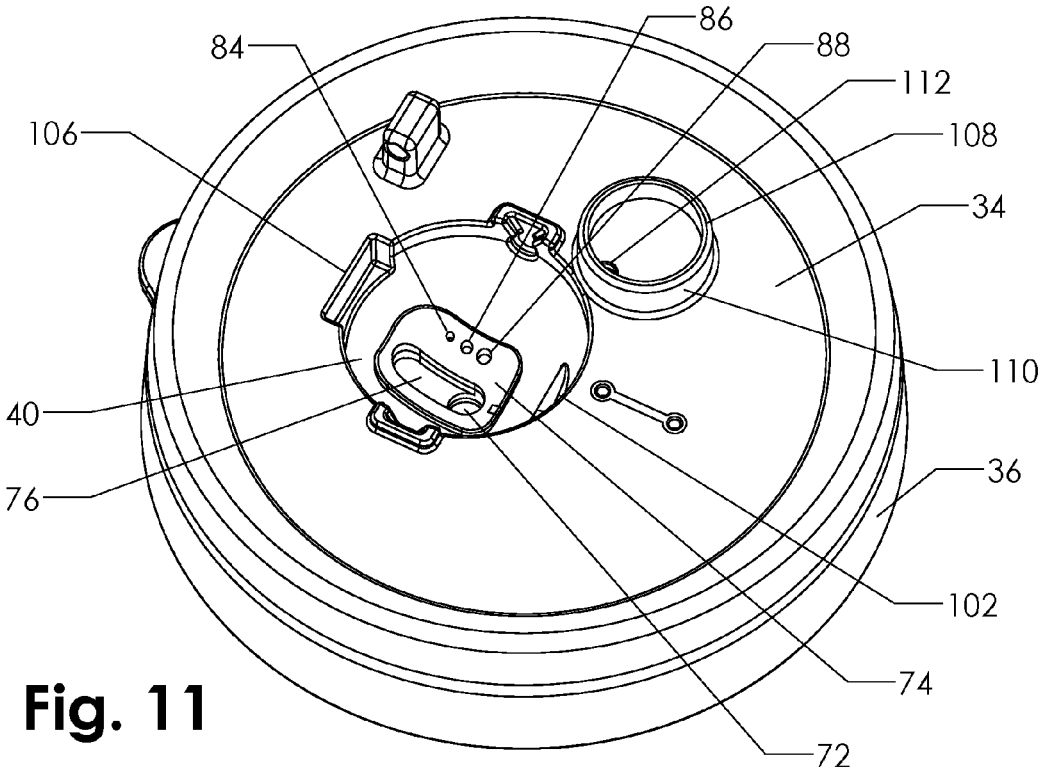
FIG. 11 is an isometric view taken from an oblique angle showing the top of the lid component of the lid assembly of FIG. 1.
Figure 12:
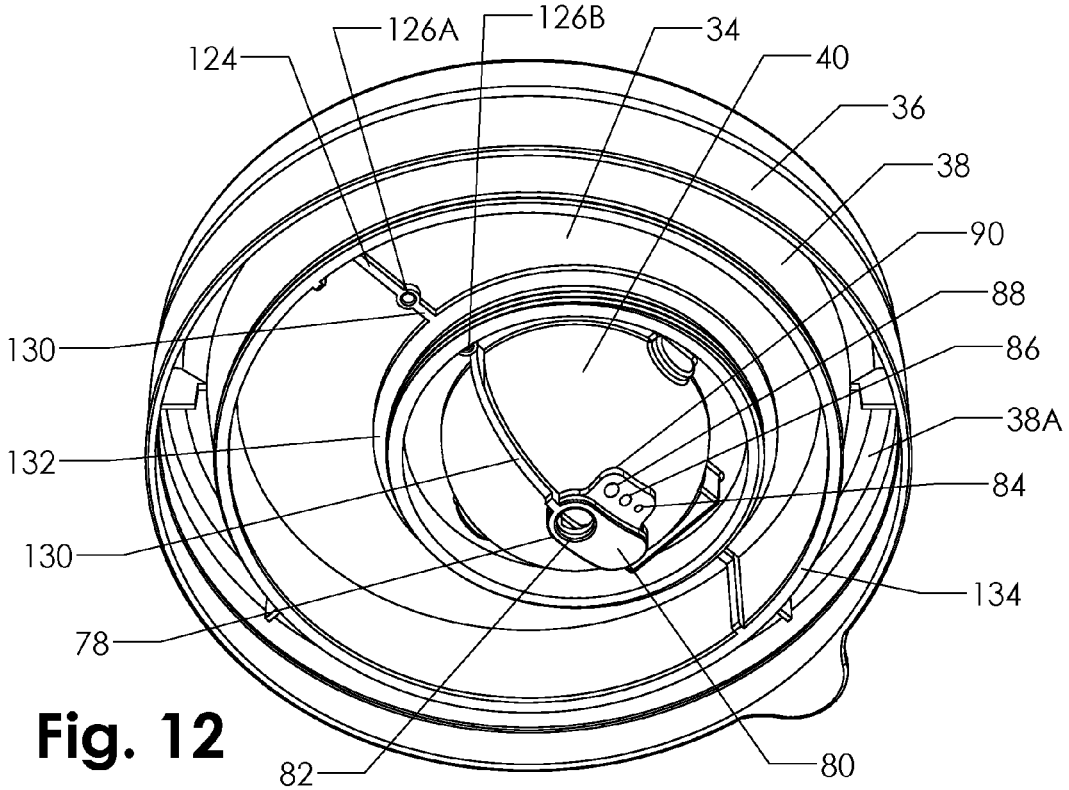
FIG. 12 is an isometric view taken from an oblique angle showing the bottom of the lid component of the assembly of FIG. 1.

As mentioned earlier the agent chamber includes a metering orifice for the base liquid to pass therethrough into the base liquid inlet port 52 of the spout, and three metering orifices for the liquid agent to pass therethrough into the agent liquid inlet port 54 of the spout. In particular, as best seen in FIG. 11, the wall making up the recess 40 (which forms the upper wall of the liquid agent chamber 28) includes a hole 72 which is axially aligned with the interior of the collar 68 and which forms the base liquid metering orifice. An elastomeric, e.g., TPE, sealing member 74 is secured on the top surface of the recess 40. The sealing member 74 includes an elongated slot 76. As best seen in FIG. 12, the undersurface of the upper wall of the agent chamber includes another elastomeric, e.g., TPE, sealing member 78 secured on it. The sealing member 78 includes a mesa 80 having a hole 82 therein. The hole 82 is axially aligned with the hole 72. The height of the mesa 80 is sufficient that when the cup-shaped member 62 is screwed onto the annular wall 60 to complete the agent chamber, the mesa engages the inner surface of the cup-shaped member 62. Accordingly, the hole 82 in the mesa will be in fluid communication with the interior of the collar 68, with the body of the mesa surrounding that opening and thereby providing an isolated passageway for the base liquid to pass through the interior of the agent chamber to the slot 76 in the elastomeric member 74 without mixing with the liquid agent within the agent chamber. The slot 76 is configured to be in fluid communication with the base liquid inlet port 52 when the spout is in any one of the second, third, fourth or fifth open positions. Thus, when the spout is in any one of those positions the base liquid can be drawn from the interior of the vessel, through the conduit 32, through the hole 82 in the elastomeric member 78, through the base liquid metering orifice 72, through the slot 76 into the base liquid inlet port 52 of the spout and from there through the passageway 56 to the mixing space 58 and hence into the mouth of the user.

The upper wall 40 of the agent chamber 28 also includes three liquid agent orifices 84, 86 and 88 for the liquid agent to pass therethrough to establish the concentration of the liquid agent delivered to the mixing space in the spout. The liquid agent metering orifice 84 is of the smallest diameter, e.g., 0.04 in. The liquid agent metering orifice 88 is of the largest diameter, e.g., .06 in and the liquid agent metering orifice 86 is of intermediate diameter, e.g., 0.075 in. The elastomeric member 74 on the top surface of the upper wall of the agent chamber 28 includes three holes in it. Each hole is axially aligned with a respective one of the orifices 84, 86 and 88 and is of a coextensive size. As best seen in FIG. 12, the elastomeric member 78 on the undersurface of the upper wall of the agent chamber includes a flanged portion 90 located immediately adjacent the mesa 80. The flanged portion 90 includes three holes in it. Each hole is axially aligned with a respective one of the orifices 84, 86 and 88 and is of a coextensive size. The height of the flanged portion 90 is less than the height of the mesa 80. Thus, when the cup-shaped member 62 is screwed onto the annular wall 60 the liquid agent metering orifices 84, 86, and 88 will be in fluid communication with the interior of the agent chamber via the holes in the flanged portion 90.

Figure 23:
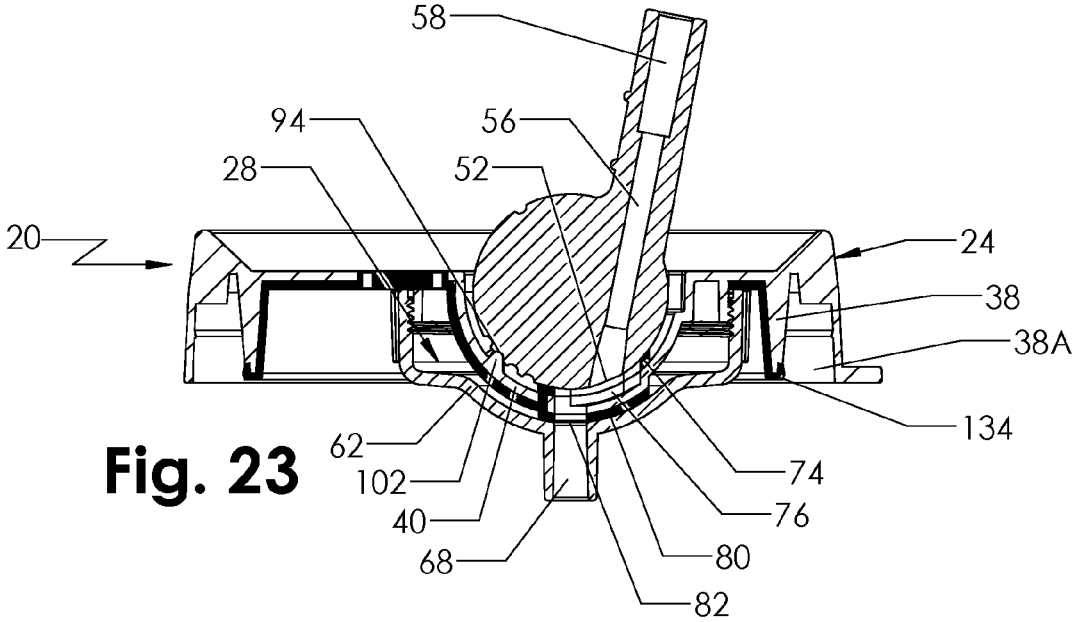
FIG. 23 is a cross sectional view of the lid assembly of the device of FIG. 1, taken along the same line as FIG. 4, but showing the device in its state wherein the spout is open for dispensing a minimum strength mixture of the base liquid and the liquid agent.
Figure 24:
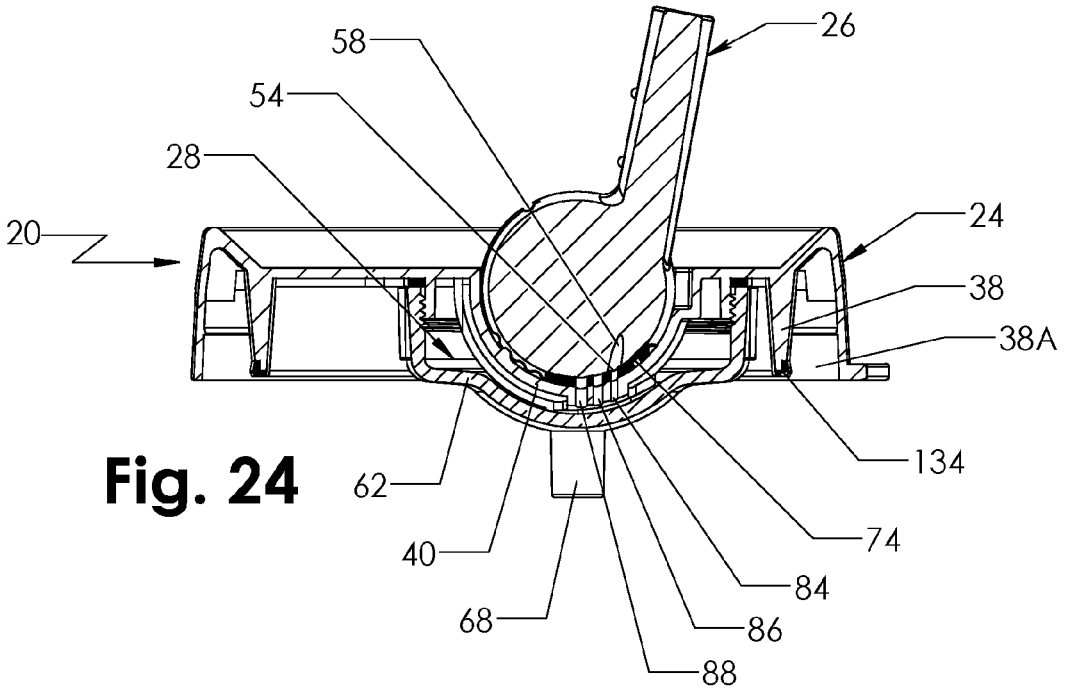
FIG. 24 is a cross sectional view of the lid assembly of the device of FIG. 1, taken along the same line as FIG. 5, but showing the device in its state wherein the spout is open for dispensing a minimum strength mixture of the base liquid and the liquid agent.

The liquid agent metering orifice 84 is arranged to be in fluid communication with the agent inlet port 54 when the spout is in the third open position, such as shown in FIGS. 23 and 24. In this position, since the diameter of the orifice 84 is the smallest of the three liquid agent metering orifices, the amount of liquid agent enabled to pass therethrough into the spout inlet port 54 will be the minimum amount. With the spout in that position the base liquid will be enabled to pass through the base liquid metering orifice 72 and the communicating slot 76 to the base liquid inlet port 52 of the spout and hence to the mixing space 58 where it will mix with the portion of the liquid agent delivered thereto. Thus, the concentration of the liquid agent in the mixed liquid or beverage delivered to the user will be the minimum concentration.

Figure 25:
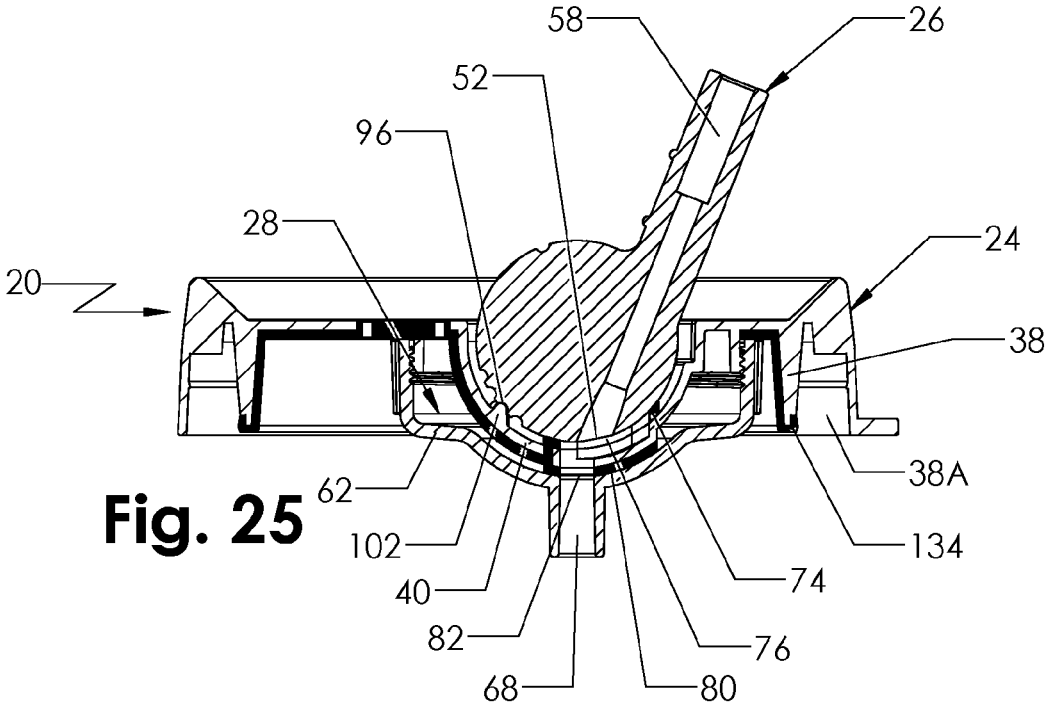
FIG. 25 is a cross sectional view of the lid assembly of the device of FIG. 1, taken along the same line as FIG. 4, but showing the device in its state wherein the spout is open for dispensing a medium strength mixture of the base liquid and the liquid agent.
Figure 26:
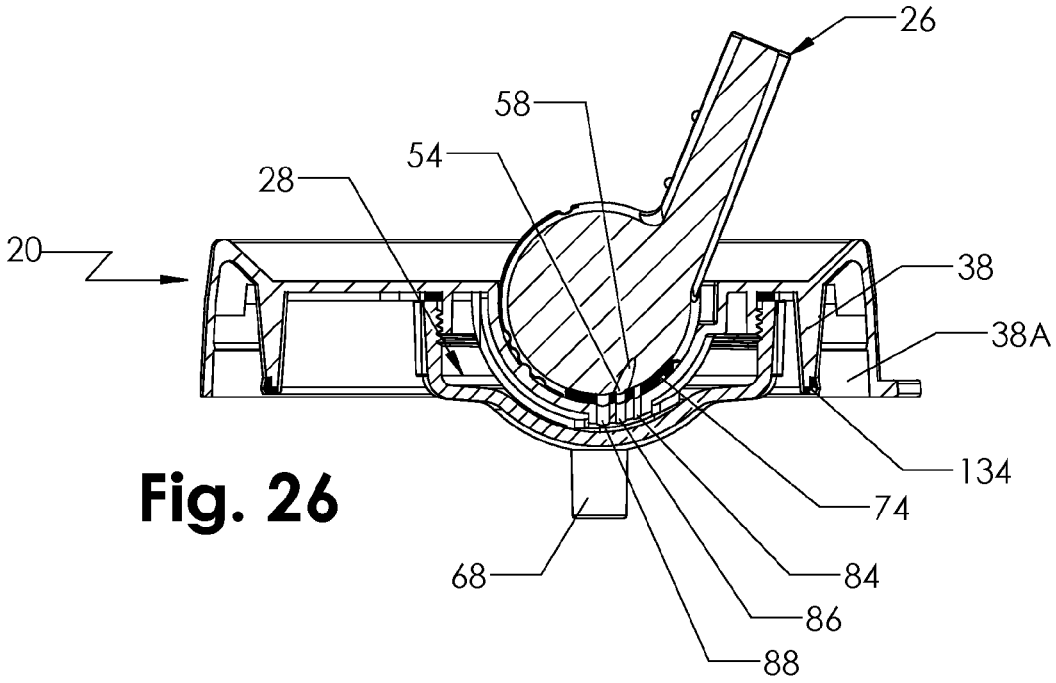
FIG. 26 is a cross sectional view of the lid assembly of the device of FIG. 1, taken along the same line as FIG. 5, but showing the device in its state wherein the spout is open for dispensing a medium strength mixture of the base liquid and the liquid agent.

The metering orifice 86 is arranged to be in fluid communication with the agent inlet port 54 when the spout is in the fourth position, such as shown in FIGS. 25 and 26. In this position, since the diameter of the orifice 86 is of intermediate size, the amount of liquid agent enabled to pass therethrough into the spout inlet port 54 will be an intermediate amount. With the spout in that position the base liquid will be enabled to pass through the base liquid metering port 72 and the communicating slot 76 to the base liquid inlet port 52 of the spout and hence to the mixing space 58 where it will mix with the portion of the liquid agent delivered thereto. Thus, the concentration of the liquid agent in the mixed liquid delivered to the user will be the intermediate concentration.

Figure 4:
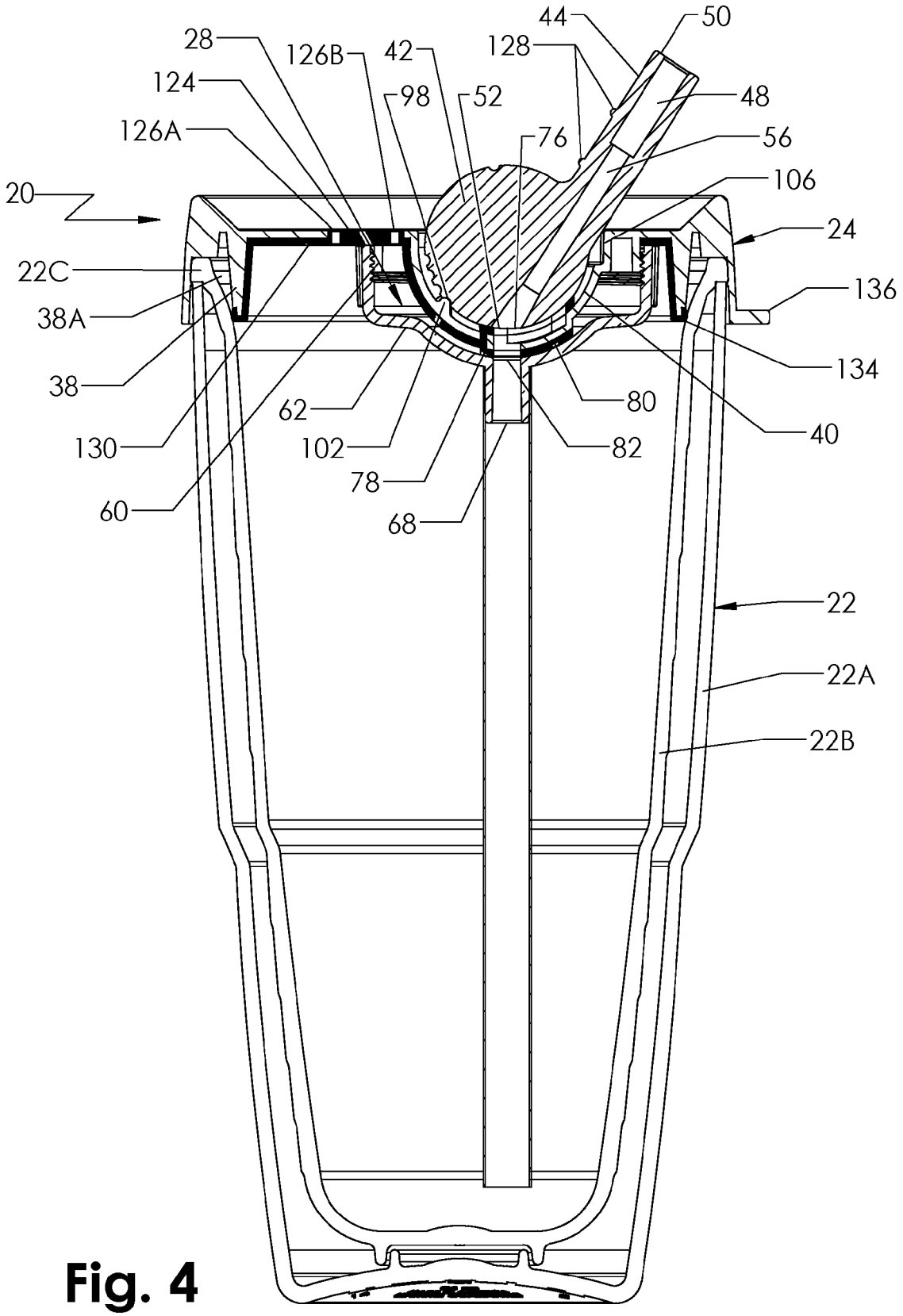
FIG. 4 is an enlarged cross-section view taken along line 4-4 of FIG. 3.
Figure 5:
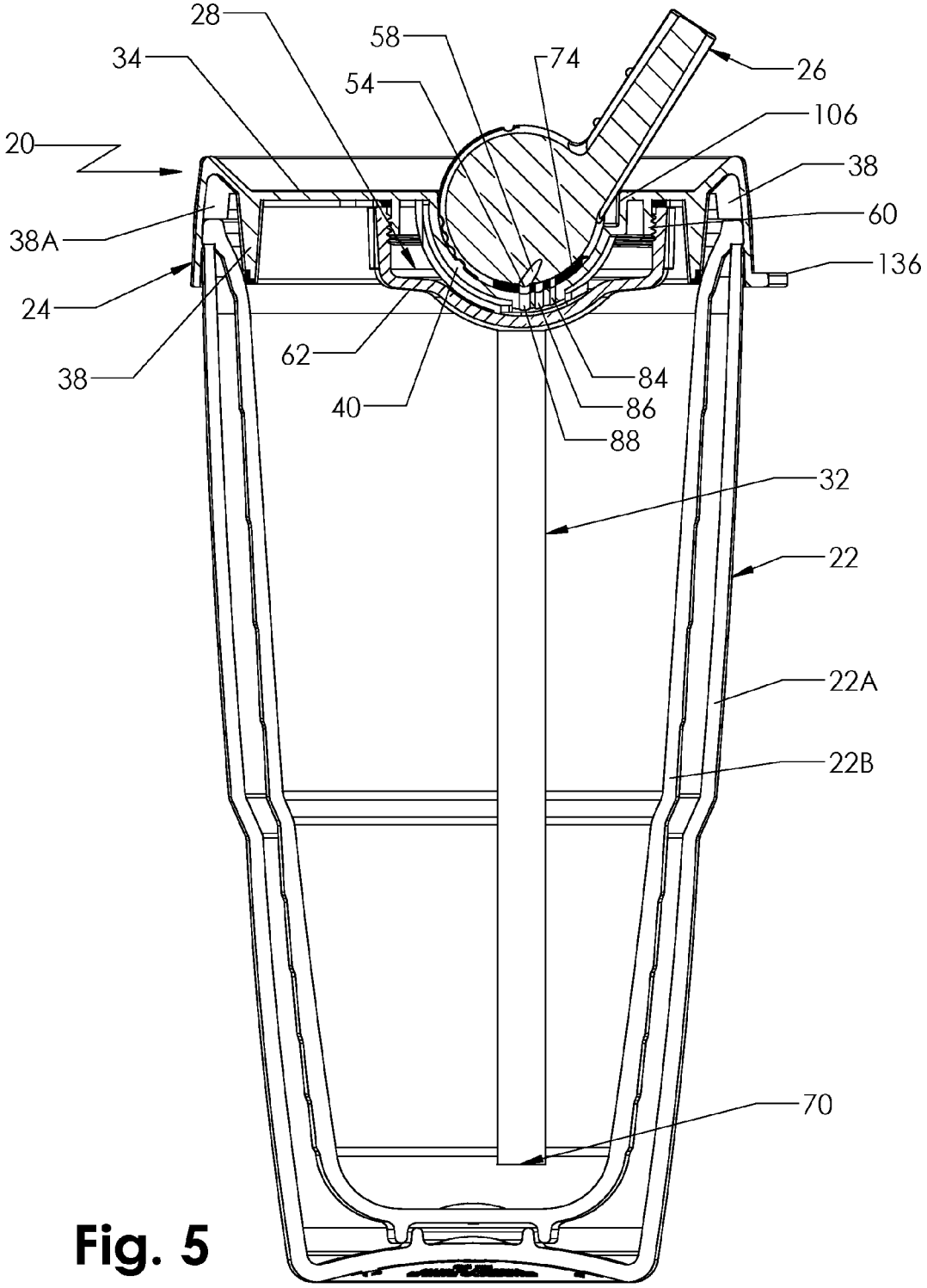
FIG. 5 is an enlarged cross-section view taken along line 5-5 of FIG. 3.
Figure 6:
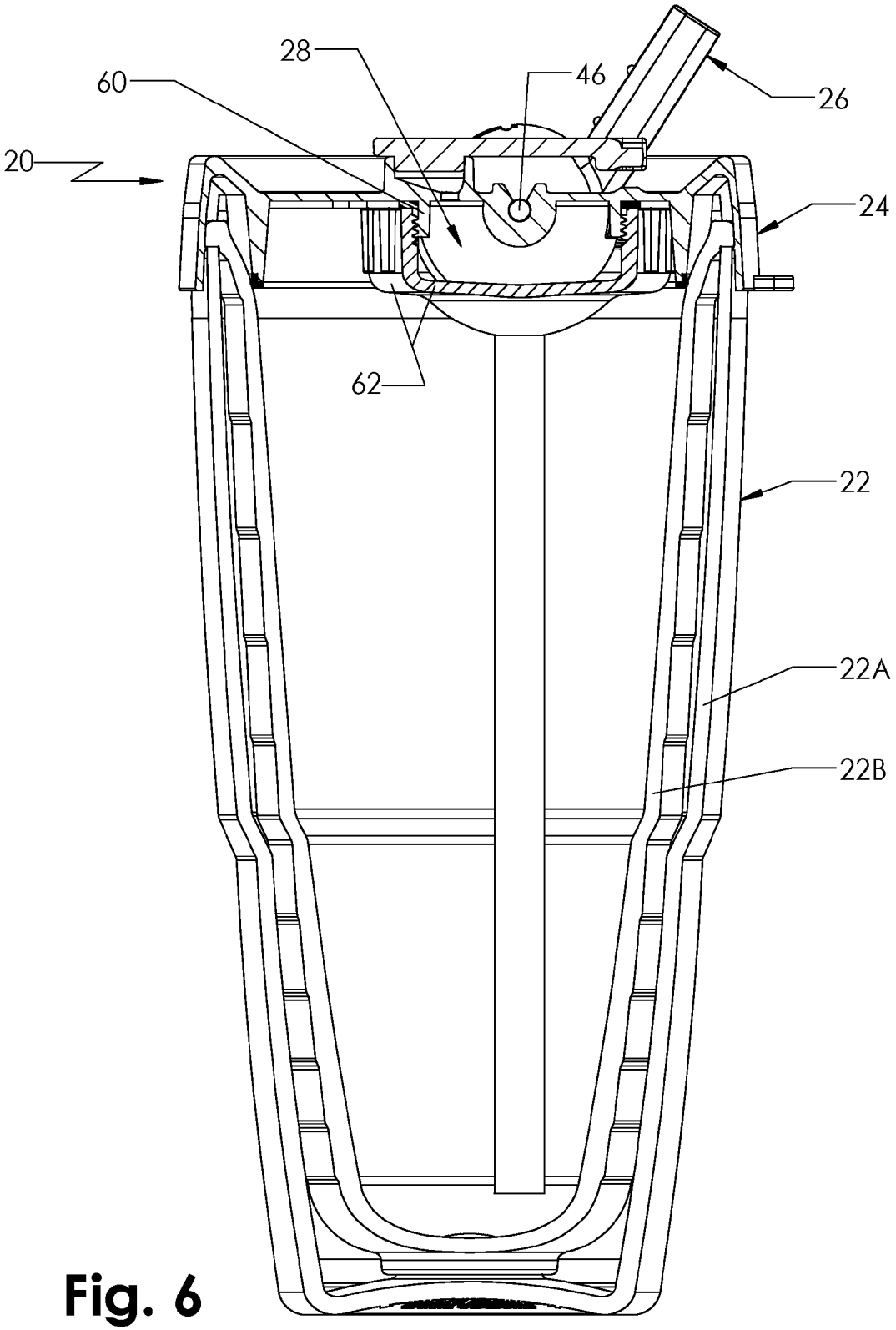
FIG. 6 is an enlarged cross-section view taken along line 6-6 of FIG. 3.

The metering orifice 88 is arranged to be in fluid communication with the agent inlet port 54 when the spout is in the fifth position, such as shown in FIGS. 4 and 5. In this position, since the diameter of the orifice 86 is of the largest size, the amount of liquid agent enabled to pass therethrough into the spout inlet port 54 will be the maximum amount. With the spout in that position the base liquid will be enabled to pass through the base liquid metering port 72 and the communicating slot 76 to the base liquid inlet port 52 of the spout and hence to the mixing space 58 where it will mix with the maximum portion of the liquid agent delivered thereto. Thus, the concentration of the liquid agent in the mixed liquid delivered to the user will be the maximum concentration.

Figure 10:
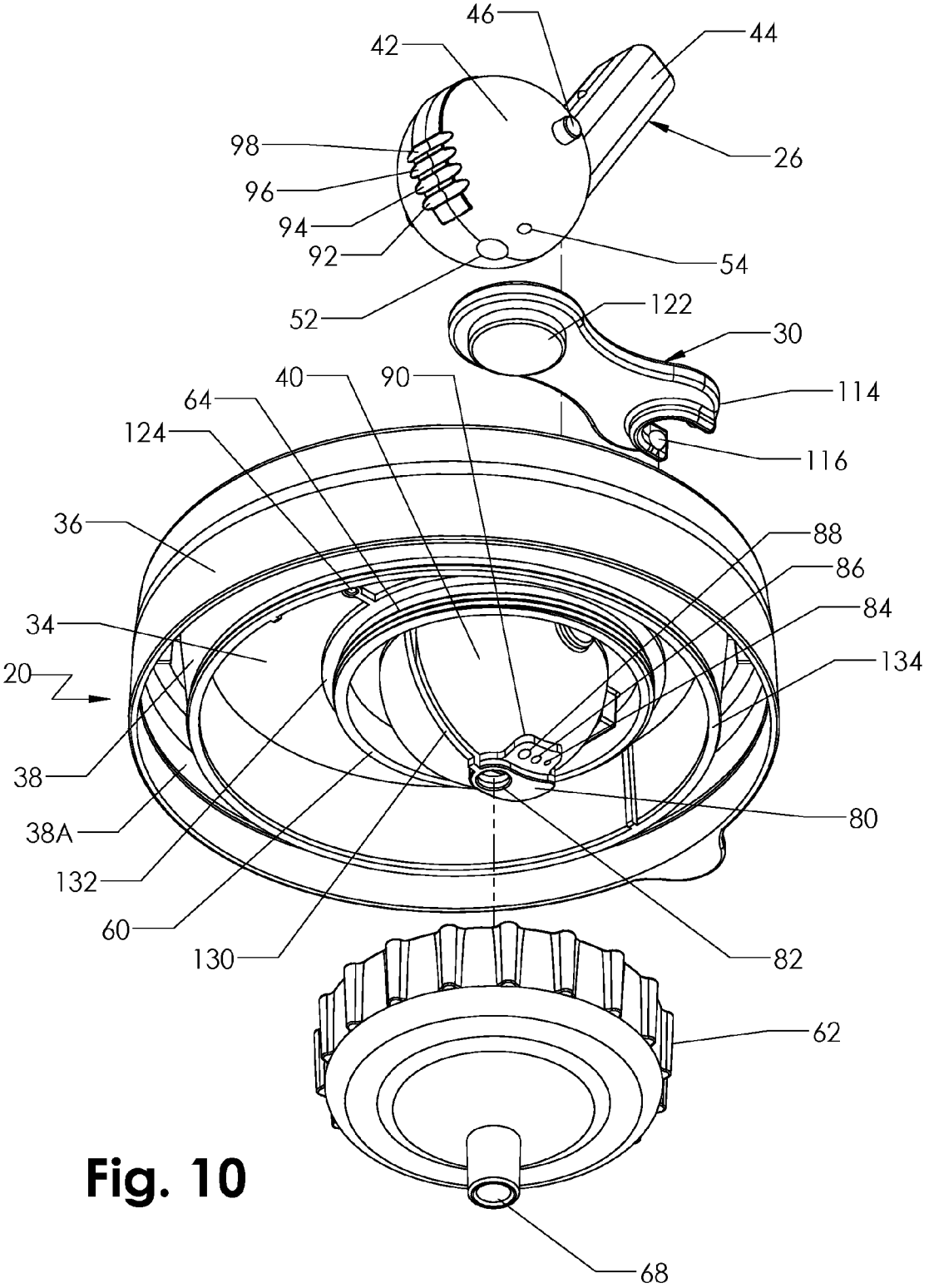
FIG. 10 is an exploded isometric view similar to FIG. 9 but taken from a different oblique angle.
Figure 16:
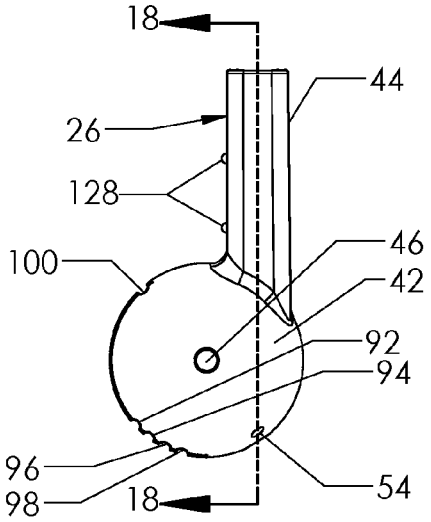
FIG. 16 is a side elevation view of the spout component of the lid assembly of FIG. 1.
Figure 17:
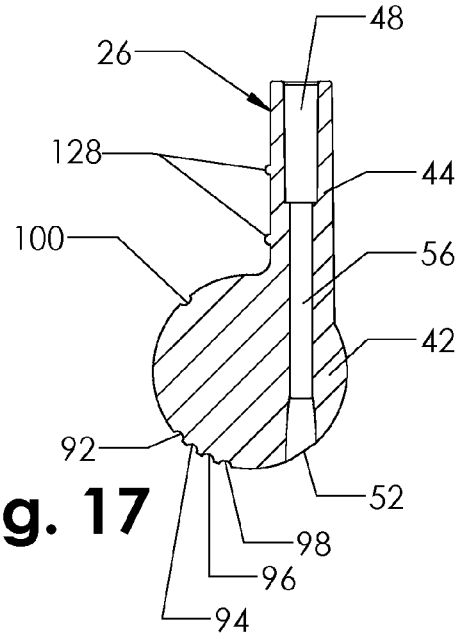
FIG. 17 is a cross-sectional view taken along line 17-17 of FIG. 15.
Figure 18:
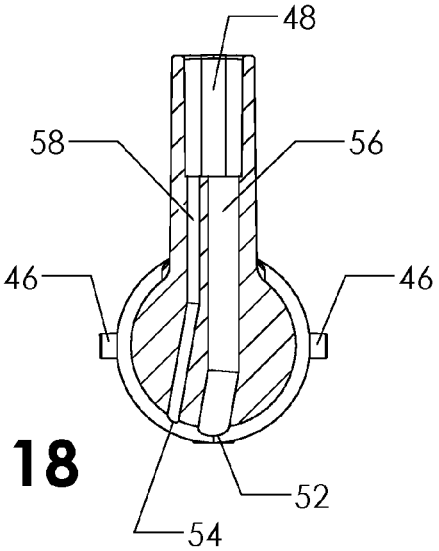
FIG. 18 is a cross-sectional view taken along line 18-18 of FIG. 16.
Figure 19:
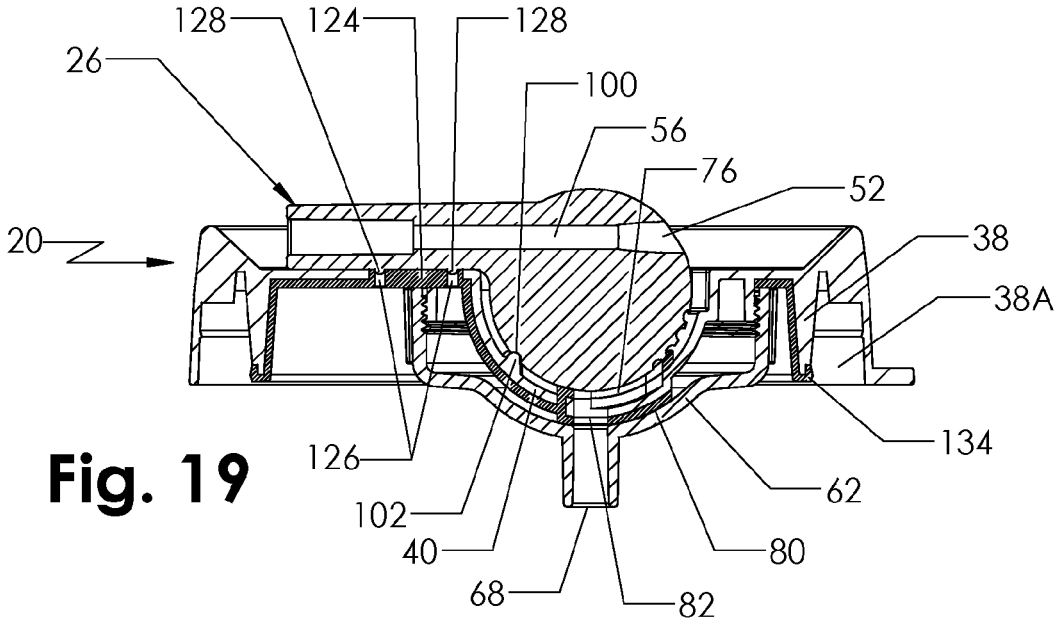
FIG. 19 is a cross sectional view of the lid assembly of the device of FIG. 1, taken along the same line as FIG. 4, but showing the device in its state wherein the spout is closed.
Figure 21:
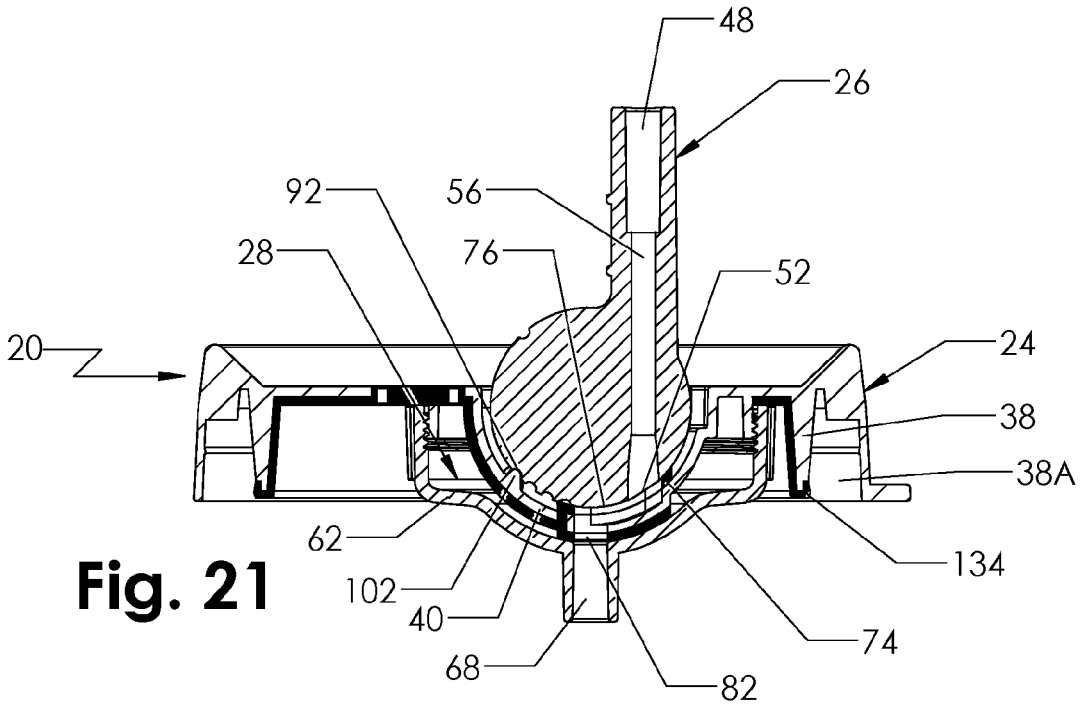
FIG. 21 is a cross sectional view of the lid assembly of the device of FIG. 1, taken along the same line as FIG. 4, but showing the device in its state wherein the spout is open for dispensing only the base liquid.
Figure 22:
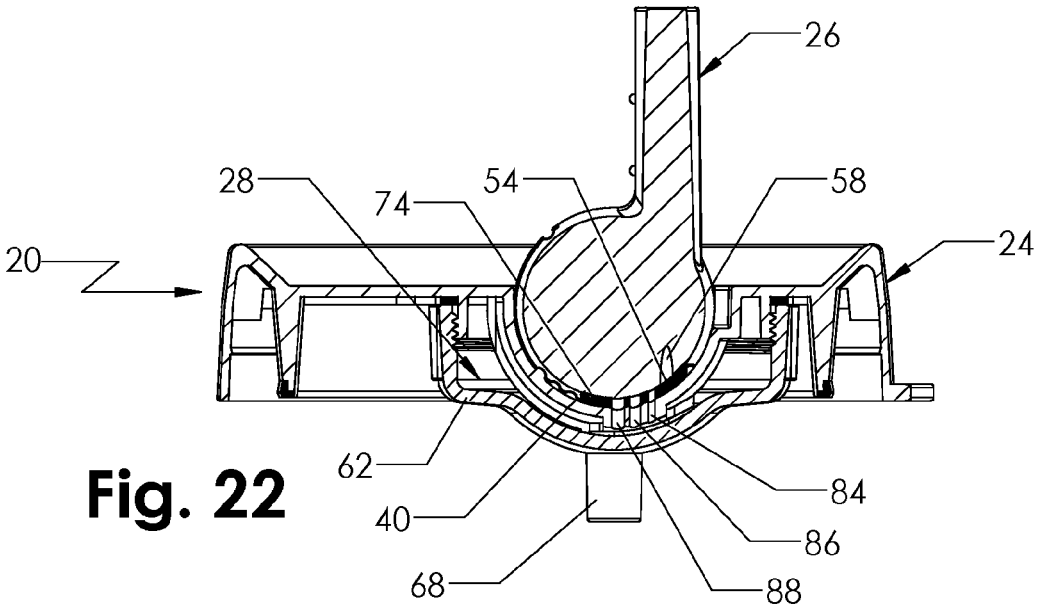
FIG. 22 is a cross sectional view of the lid assembly of the device of FIG. 1, taken along the same line as FIG. 5, but showing the device in its state wherein the spout is open for dispensing only the base liquid.

As best seen in FIGS. 10, 16 and 17 the peripheral surface of the base portion 44 of the spout includes four recess 92, 94, 96 and 98 extending parallel to the pivot axis A and located adjacent the inlet ports 52 and 54. A fifth recess 100 extends parallel to the pivot axis A and is located adjacent the interface of the lower and upper sections 42 and 44, respectively of the spout. The recesses 92-98 form a portion of a detent mechanism for holding the spout in the four open positions. In particular, as best seen in FIG. 21 the recess 92 is arranged to be engaged by a somewhat elongated rounded projection 102 (FIGS. 11 and 13) in the recess 40 to hold the spout in the second open position. As best seen in FIG. 23 the recess 94 is arranged to be engaged by the projection 102 in the recess 40 to hold the spout in the third open position. As best seen in FIG. 25 the recess 96 is arranged to be engaged by the projection 102 in the recess 40 to hold the spout in the fourth open position. As best seen in FIG. 23 the recess 98 is arranged to be engaged by the projection 102 in the recess 40 to hold the spout in the fifth open position. As best seen in FIG. 19 the recess 100 is arranged to be engaged by the projection 102 in the recess 40 to hold the spout in the first or closed position.

The pivotable mounting of the spout 26 within the recess 40 is achieved by means of a pair of notches 104 (FIGS. 2, 9 and 11), which are located on diametrically opposed sides of the recess 40 for receipt of respective pivot pins 46 of the spout. As can be seen in FIGS. 1, 4, 5, 9, 11 and 13 the recess 40 also includes a rectangular cut out portion 106 located on an axis perpendicular to the pivot axis A of the spout for receipt of the upper portion 44 of the spout, when the spout is in its maximum open (i.e., fifth) position.

With the spout pivotably mounted in the recess 40 as described above the peripheral surface of the bottom portion 42 of the spout contiguous with the base liquid inlet port 52 forms a good fluid-tight seal with the portion of the elastomeric sealing member 74 surrounding the slot 76 irrespective of the angular position of the spout. Moreover, the portion of the mesa 80 of the elastomeric sealing member 78 surrounding the hole 82 forms a good fluid tight seal between the upper wall 40 of the agent chamber 28 and the cup-shaped member 62 forming the bottom wall of that chamber. Thus, when the spout is in any one of the second, third, fourth or fifth open positions the base liquid from the conduit 32 will be enabled to flow into the base liquid inlet port 52 of the spout from the base liquid metering orifice 72, without leakage into the interior of the agent chamber 28. The peripheral surface of the bottom portion 42 of the spout contiguous with the liquid agent inlet port 52 forms a fluid-tight seal with the elastomeric member 74 surrounding the openings in that seal which are aligned with the liquid agent metering orifices 84, 86 and 88. Thus, when the spout is in any one of the third, fourth or fifth open positions the liquid agent from the agent chamber 28 will be enabled to flow directly into the base liquid inlet port 54 of the spout. When the spout is in the first or closed position, the base liquid inlet port 52 of the spout will be isolated from the base liquid metering orifice 72 and the liquid agent inlet port 54 will be isolated from each of the liquid agent metering orifices 84, 86 and 88, so that no liquid can flow into the spout.

As should be appreciated by those skilled in the art the use of the sealing member 74 renders tolerances between the spout and the agent chamber unimportant, so long as the sealing member 74 is of sufficient durometer to form good liquid-tight seal surrounding the interface of the inlet port 54 and the liquid agent orifices 84, 86, and 88. Such action provides a continuous path for the liquid agent to flow into the spout while preventing its leakage out of that interface. Similarly, the sealing member 78 ensures that the base liquid can flow directly from the conduit 32 into the base liquid inlet port 52 without leakage into the liquid agent chamber so long as the sealing member 78 is of sufficient durometer to form good liquid-tight seal surrounding that liquid path through the agent chamber when the cup-shaped member 62 is screwed onto the annular wall 60.

Figure 9:
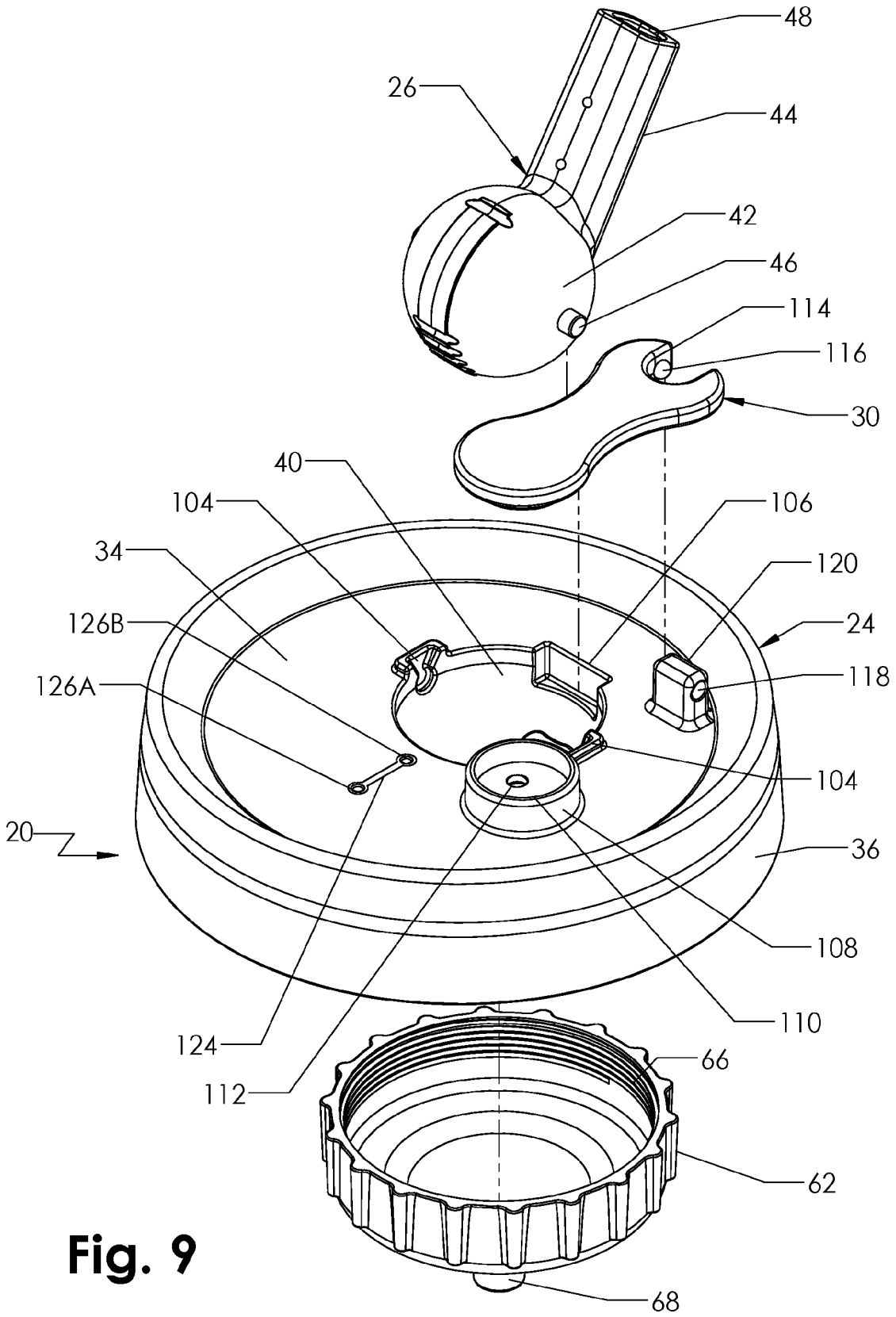
FIG. 9 is an exploded isometric view taken from an oblique angle showing the lid assembly of FIG. 1.
Figure 13:
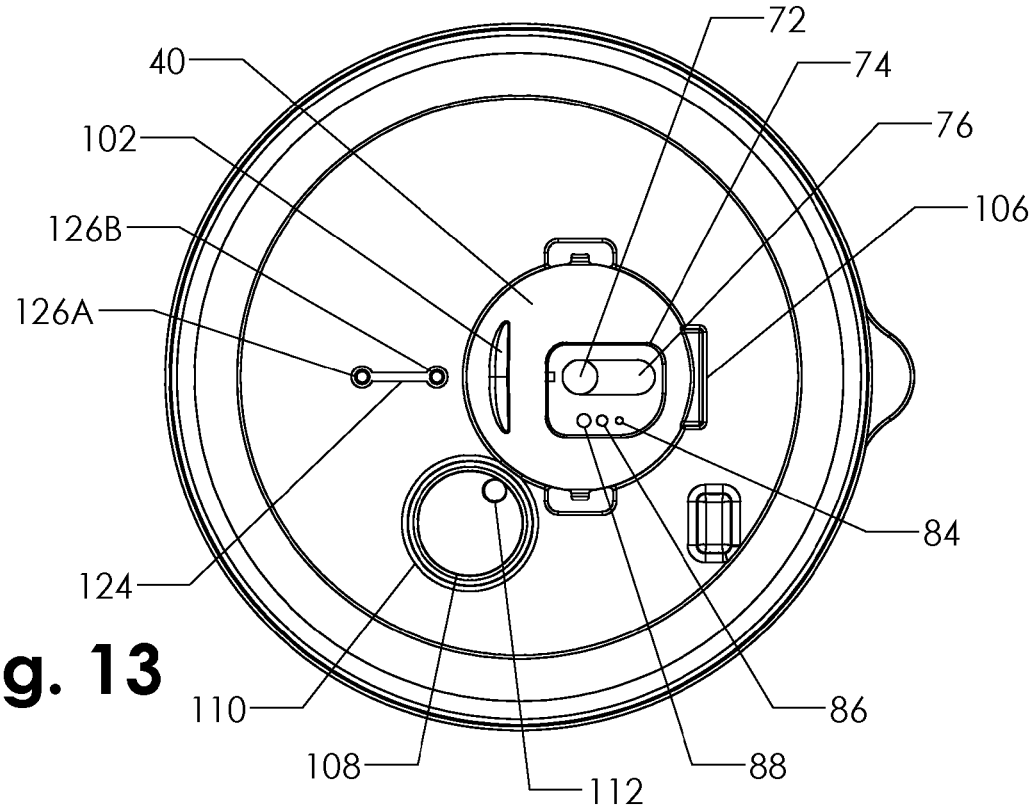
FIG. 13 is a top plan view of the lid component of the lid assembly of FIG. 1.

The liquid agent chamber 28 is arranged to be filled with the liquid agent by means of a filling portal 108. That portal is best seen in FIGS. 9 and 13 and basically comprises an annular wall 110 projecting upward from the top surface of the upper wall 34 of the lid 24. The portion of the upper wall of the lid surrounded by the annular wall 110 is somewhat concave and includes a hole 112 at its nadir. The hole 112 is in fluid communication with the agent chamber 28. Thus, any liquid agent desired to be used can be provided into the agent chamber by pouring, injecting or otherwise introducing it through the hole 112.

The heretofore identified cap 30 serves to close off the inlet portal 108 when it is not in use to fill the agent chamber. The cap 30 is best seen in FIGS. 9 and 10 and is in the form of a generally planar elongate member having a yoke 114 at one end thereof from which a pair of pivot nubs 116 project inward axially aligned with each other. The nubs are configured to be received within respective recesses 118 in a stand-off 120 located on the top surface of the lid 24 to pivotably connect the cap to the lid. The opposite end of the cap 30 from the yoke is in the form of a plug 122 which is configured to be snugly received in the annular wall 110 forming the filling port 108 when the cap is pivoted down into engagement with the filling portal.

Figure 3:
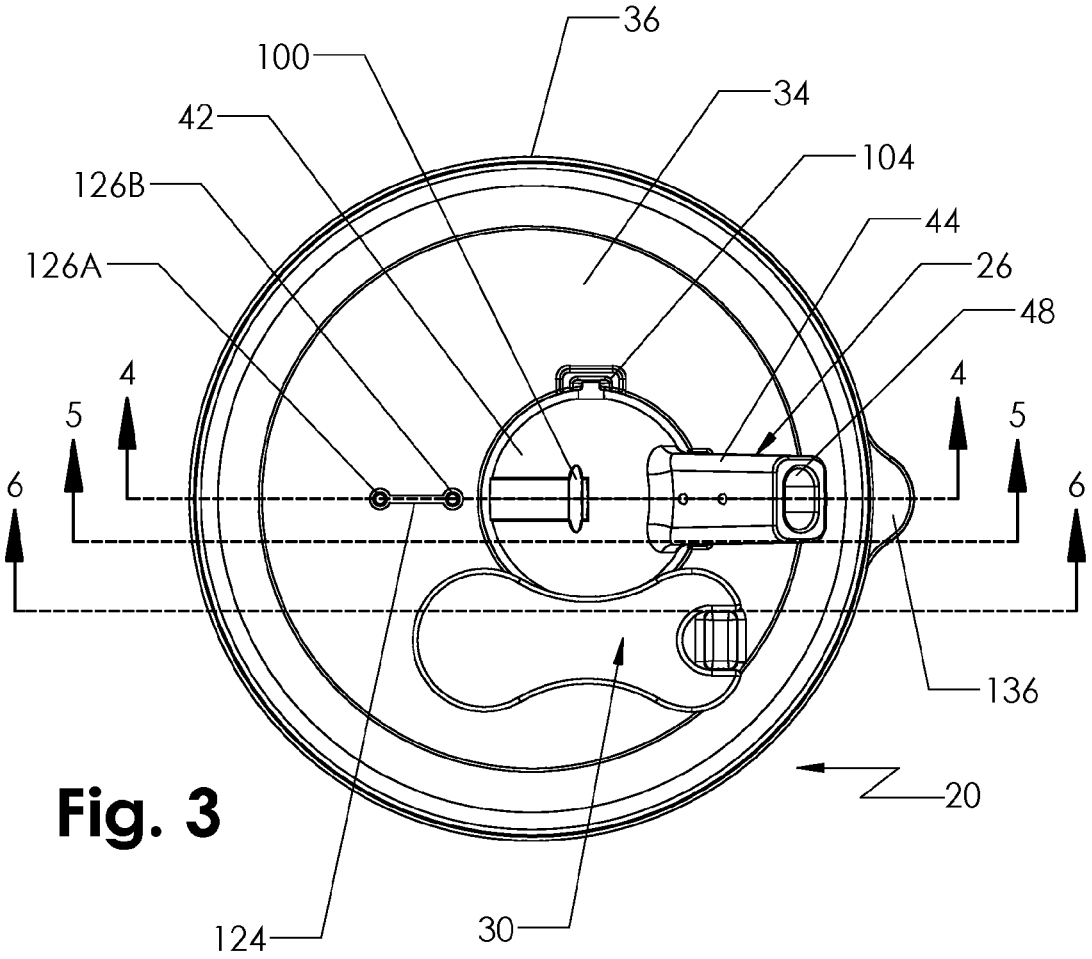
FIG. 3 is a top plan view of the device of FIG. 1.
Figure 7:
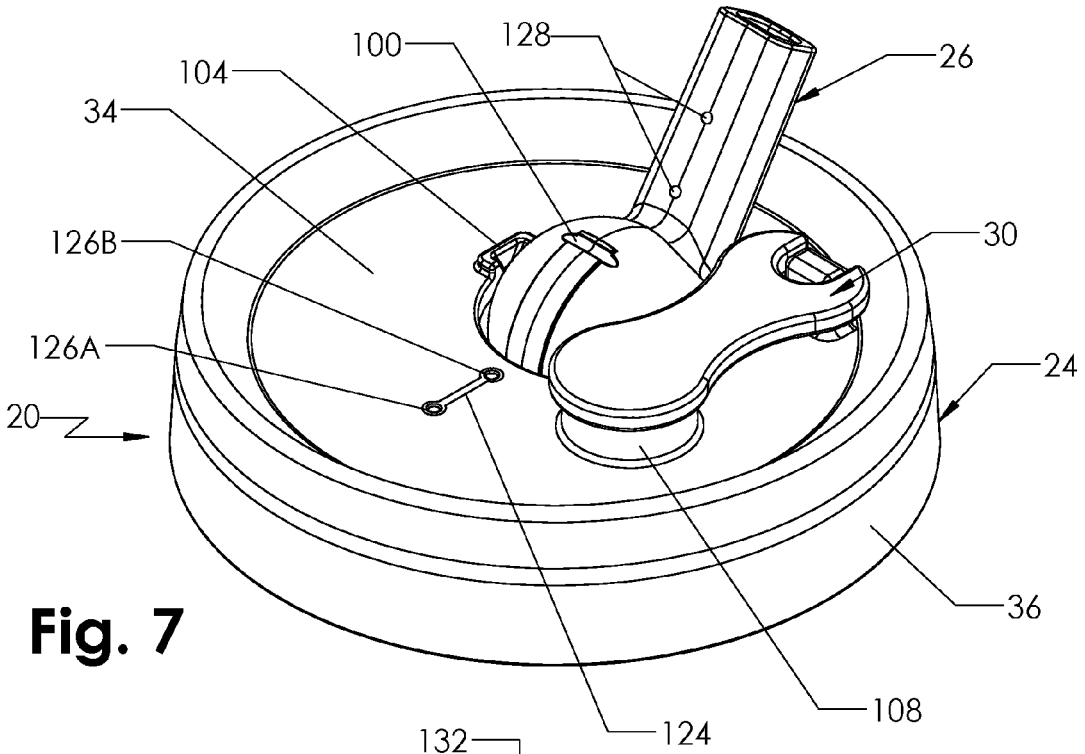
FIG. 7 is an isometric view taken from an oblique angle showing the top of the lid assembly of FIG. 1.
Figure 8:
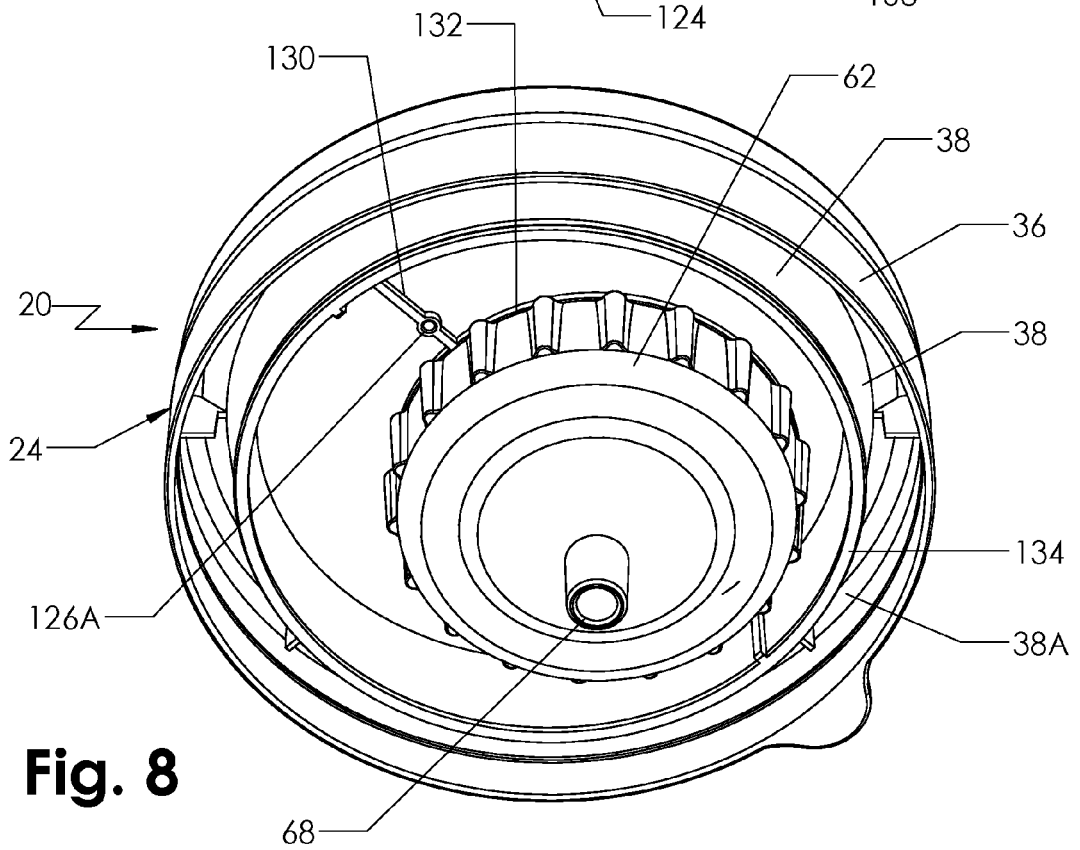
FIG. 8 is an isometric view taken from an oblique angle showing the bottom of the lid assembly of FIG. 1.
Figure 14:
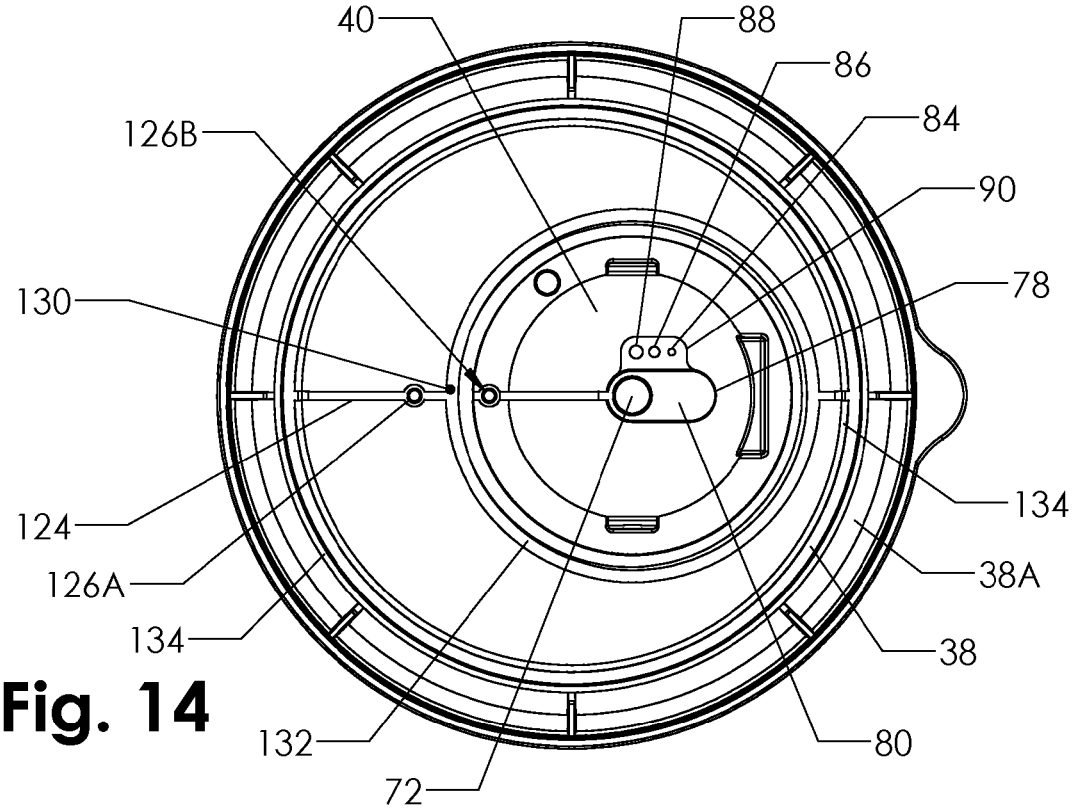
FIG. 14 is a bottom plan view of the lid component of the lid assembly of FIG. 1.
Figure 15:
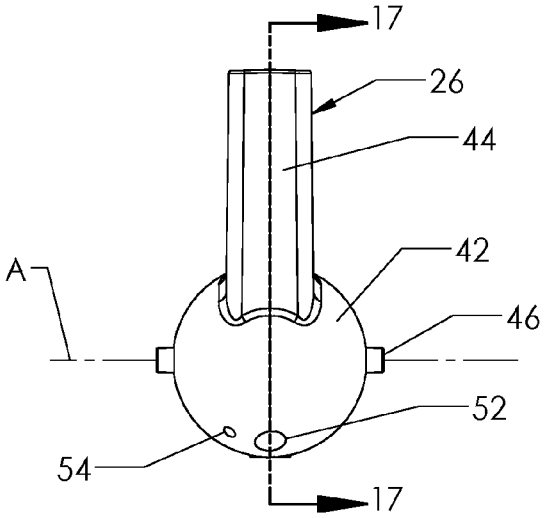
FIG. 15 is a front elevation view of the spout component of the lid assembly of FIG. 1.

As best seen in FIGS. 3, 4 and 7 the top wall 34 of the lid 24 also includes an elastomeric member 124 in which a two vent holes 126A and 126B are located. The elastomeric member 124 extends through a slot in the top wall 34 with one vent hole 126A located so that it is in fluid communication with the interior of the vessel 24 when the lid assembly is secured to the vessel. As best seen in FIGS. 12 and 14 the vent hole 126B is located so that it is in fluid communication with the interior of the agent chamber 28. The dual vent holes 126A and 126B enable air to be drawn into the vessel and into the agent chamber when the user sucks on the spout during use of the device 20 to replace the withdrawn liquids with air and thereby facilitate the drinking process.

In order to close off the vent holes 126A and 126B when the lid assembly is in its closed position or state, to thereby prevent any leakage of liquid through those vent holes, the spout 26 includes a pair of nubs or projections 128 (FIGS. 4, 7, 16 and 17) on the undersurface of the portion 144. The nubs 128 are configured to snugly fit within the vent holes 126 to form a liquid-tight seal with the vent holes when the spout is in the closed state.

In accordance with one preferred aspect of this invention and in the interest of simplicity of construction (e.g., a low parts count), ease of manufacturing and assembly, the elastomeric member 124 forms one portion of an integral elastomeric member 130 (FIG. 12), a portion of which is in the form of a first sealing ring 132, a second sealing ring 134, and the heretofore identified sealing members 74 and 78. The sealing ring 132 is located on the underside of the top wall 34 of the lid and surrounding the annular wall 60 to form a liquid-tight seal between the underside of the top wall of the lid and the cup-shaped base 62 when the cup shaped base is screwed onto that annular wall. Thus, the liquid agent within the agent chamber 28 is prevented from leaking out of the interface between the cup-shaped base and the top wall 34 of the lid. The sealing ring 134 is located on the free edge of the annular wall 28 of the lid for engagement with the inner surface of the inner vessel 22B when the lid assembly is mounted on the vessel to form a liquid-tight interface thereat. The integral elastomeric member 130 can be formed of any suitable material, such as TPE.

Figure 20:
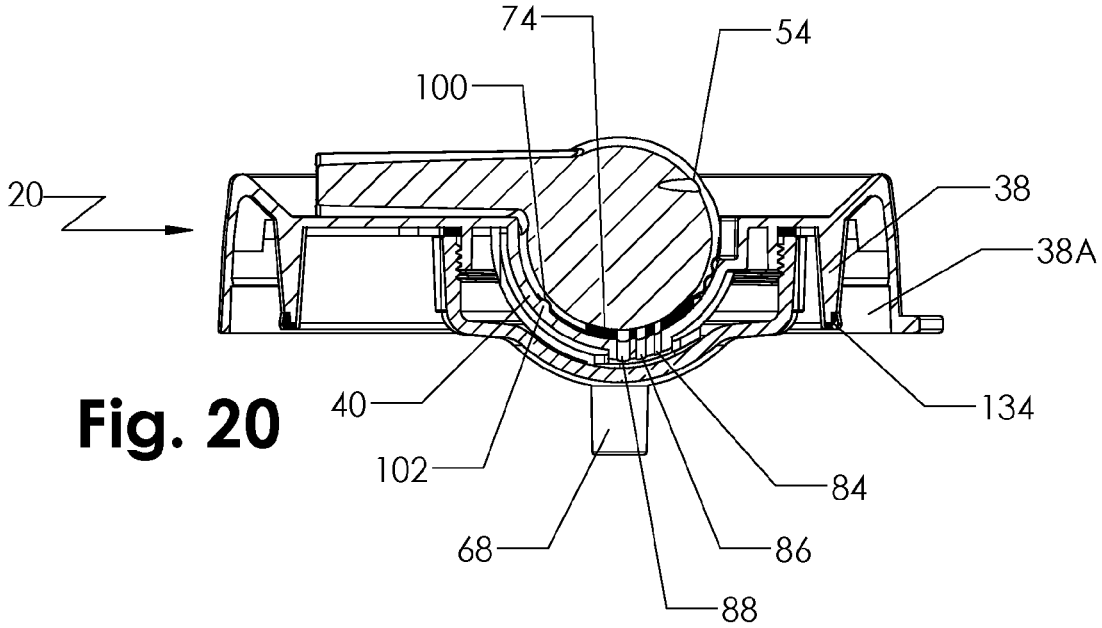
FIG. 20 is a cross sectional view of the lid assembly of the device of FIG. 1, taken along the same line as FIG. 5, but showing the device in its state wherein the spout is closed.

The use of a vessel on which a lid assembly 20 is mounted will now be discussed. To that end, the user removes the lid assembly 20 from the vessel 22, if it was previously on the vessel, by pulling on a tab 136 (FIG. 1) to lift the lid assembly off of the rim of the vessel 22. The user can then fill the interior of the vessel with the desired base liquid by pouring it into the interior of the vessel. The lid assembly is then replaced on the vessel by inserting the rim of the vessel into the annular space 38 of the lid. If the agent chamber 28 had not been previously filled with the liquid agent, or there isn't a sufficient amount of the liquid agent in the agent chamber for the user's desire, the user can fill the agent chamber by pouring or otherwise introducing the liquid agent through the filling portal 108 and then closing the cap 30 to prevent any of it to gain egress out of the filling portal. In order to prevent any of the base liquid or any mixture of the base liquid and the liquid agent from leaking out of the spout, all that the user has to do is to pivot the spout to the first (closed) position, shown in FIGS. 19 and 20, if it was not already in that positon. Should the user wish to drink only the base liquid from the vessel, all that is required of the user is to pivot the spout to the second (open) position, so that the base liquid inlet port 52 of the spout is in fluid communication with the base liquid orifice 72 via the slot 76. Thus, when the user sucks on the free end of the spout the suction produced at the free end 70 of the conduit 32 (which is located at the bottom of the interior of the vessel 22) will draw the base liquid into the conduit from whence it will flow into the inlet port of the spout. From there the base liquid will flow through the passageway 56 to the mixing space 58 and out through the free end of the spout into the user's mouth.

Should the user wish to drink a mixture of the base liquid and the liquid agent wherein the mixture has the minimum concentration of the liquid agent in it, all that the user has to do is to pivot the spout to the third (open) position and then suck on the free end of the spout. With the spout in the third position the base liquid inlet port 52 of the spout is in fluid communication with the base liquid orifice 72 via the slot 76, and the liquid agent inlet port 54 is in fluid communication with the small liquid agent metering orifice 84. Accordingly, the suction produced by the user will draw the base liquid into the conduit from whence it will flow into the inlet port of the spout. From there the base liquid will flow through the passageway 56 to the mixing space 58. At the same time a portion of the liquid agent within the agent chamber 28 will be drawn through the liquid agent metering orifice 84 into the liquid agent inlet port 54 of the spout from whence it will flow through the passageway 58 to the mixing space. Accordingly, the small amount of liquid agent will mix with the base liquid in the mixing space and that mixture will pass out through the free end of the port into the user's mouth.

As should be appreciated by those skilled in the art, because the spout is double barreled (i.e., has separate or discrete passageways 56 and 58 for the base liquid and the liquid agent, respectively) and has a mixing space located immediately adjacent the free end of the spout, the flavoring agent and the base liquid are not mixed until they reach the mixing space, which is remote from the interior of the vessel. Thus, if there is any backflow from the mixing space into the interior of the vessel, there would only be a very tiny amount of liquid agent, i.e., that which entered the mixing space, that could flow back through the conduit into the base liquid in the vessel.

Use of the vessel with the lid assembly 20 to enable the user to drink an intermediate strength mixture of the liquid agent is achieved in a similar manner. To that end, all that the user has to do is to pivot the spout to the fourth (open) position. With the spout in the fourth position the base liquid inlet port 52 of the spout is in fluid communication with the base liquid orifice 72 via the slot 76, and the liquid agent inlet port 54 is in fluid communication with the intermediate size liquid agent metering orifice 86. Accordingly, the suction produced by the user will draw the base liquid into the conduit from whence it will flow into the inlet port of the spout. From there the base liquid will flow through the passageway 56 to the mixing space 58. At the same time a portion of the liquid agent within the agent chamber 28 will be drawn through the liquid agent metering orifice 86 into the liquid agent inlet port 54 of the spout from whence it will flow through the passageway 58 to the mixing space. Accordingly, the intermediate amount of liquid agent will mix with the base liquid in the mixing space and the mixture will pass out through the free end of the port into the user's mouth.

Use of the vessel with the lid assembly 20 to enable the user to drink a maximum strength mixture of the liquid agent is achieved in a similar manner. To that end, all that the user has to do is to pivot the spout to the fifth (open) position. With the spout in the fifth position the base liquid inlet port 52 of the spout is in fluid communication with the base liquid orifice 72 via the slot 76, and the liquid agent inlet port 54 is in fluid communication with the large size liquid agent metering orifice 88. Accordingly, the suction produced by the user will draw the base liquid into the conduit from whence it will flow into the inlet port of the spout. From there the base liquid will flow through the passageway 56 to the mixing space 58. At the same time a portion of the liquid agent within the agent chamber 28 will be drawn through the liquid agent metering orifice 88 into the liquid agent inlet port 54 of the spout from whence it will flow through the passageway 58 to the mixing space. Accordingly, the maximum amount of liquid agent will mix with the base liquid in the mixing space and the mixture will pass out through the free end of the port into the user's mouth.

After the user has used the vessel with the lid assembly on this invention on it to drink from the vessel, all that the user has to do to close the vessel to prevent any leakage of liquid from the spout is to pivot the spout back to the first (closed) position. Should the user wish to clean the vessel and/or the lid assembly, all that is required is to remove the lid assembly from the vessel by pulling on the lid's tab 136.

Figure 27:
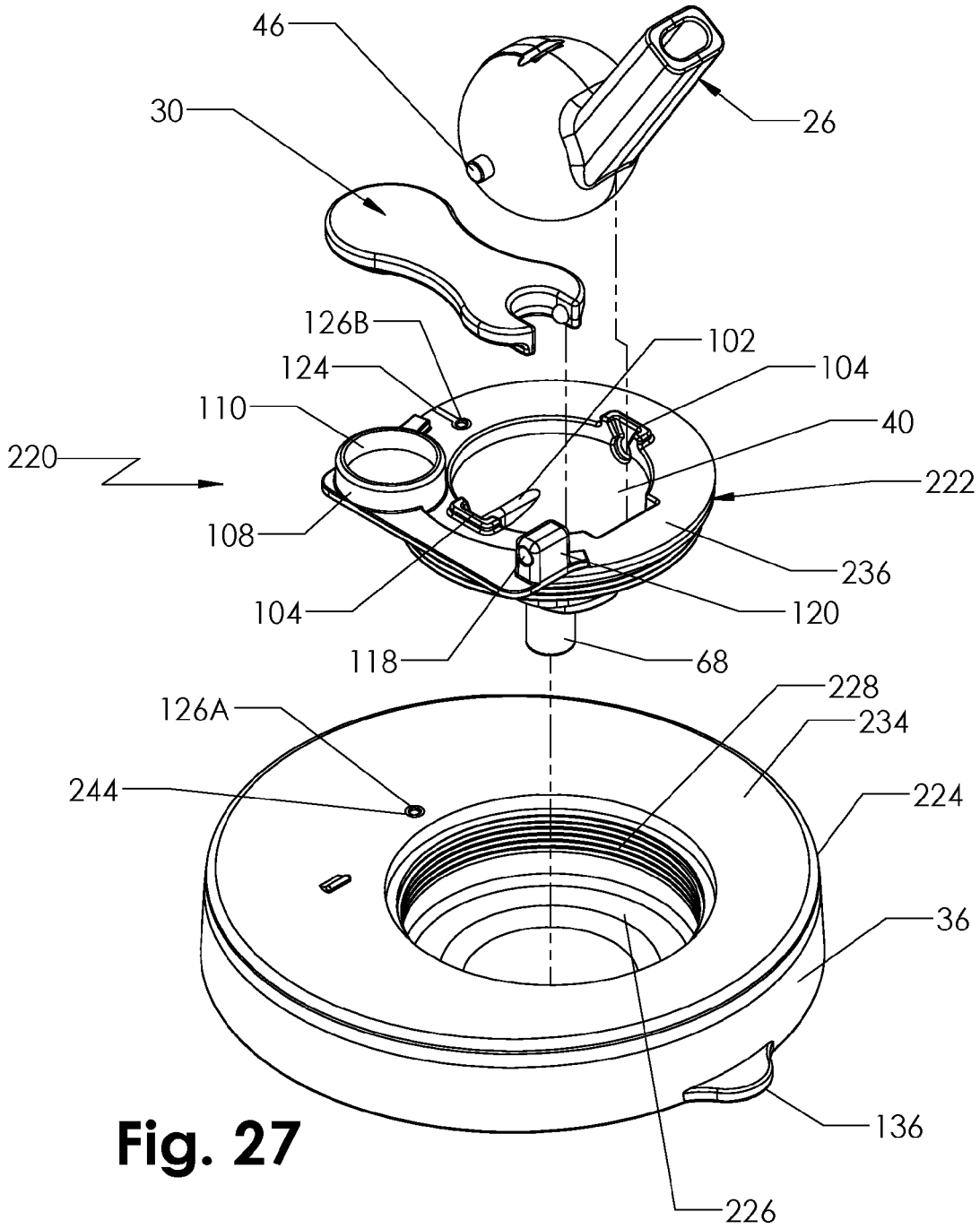
FIG. 27 is an exploded isometric view taken from an oblique angle of a second exemplary embodiment of a lid assembly constructed in accordance with this invention.
Figure 28:
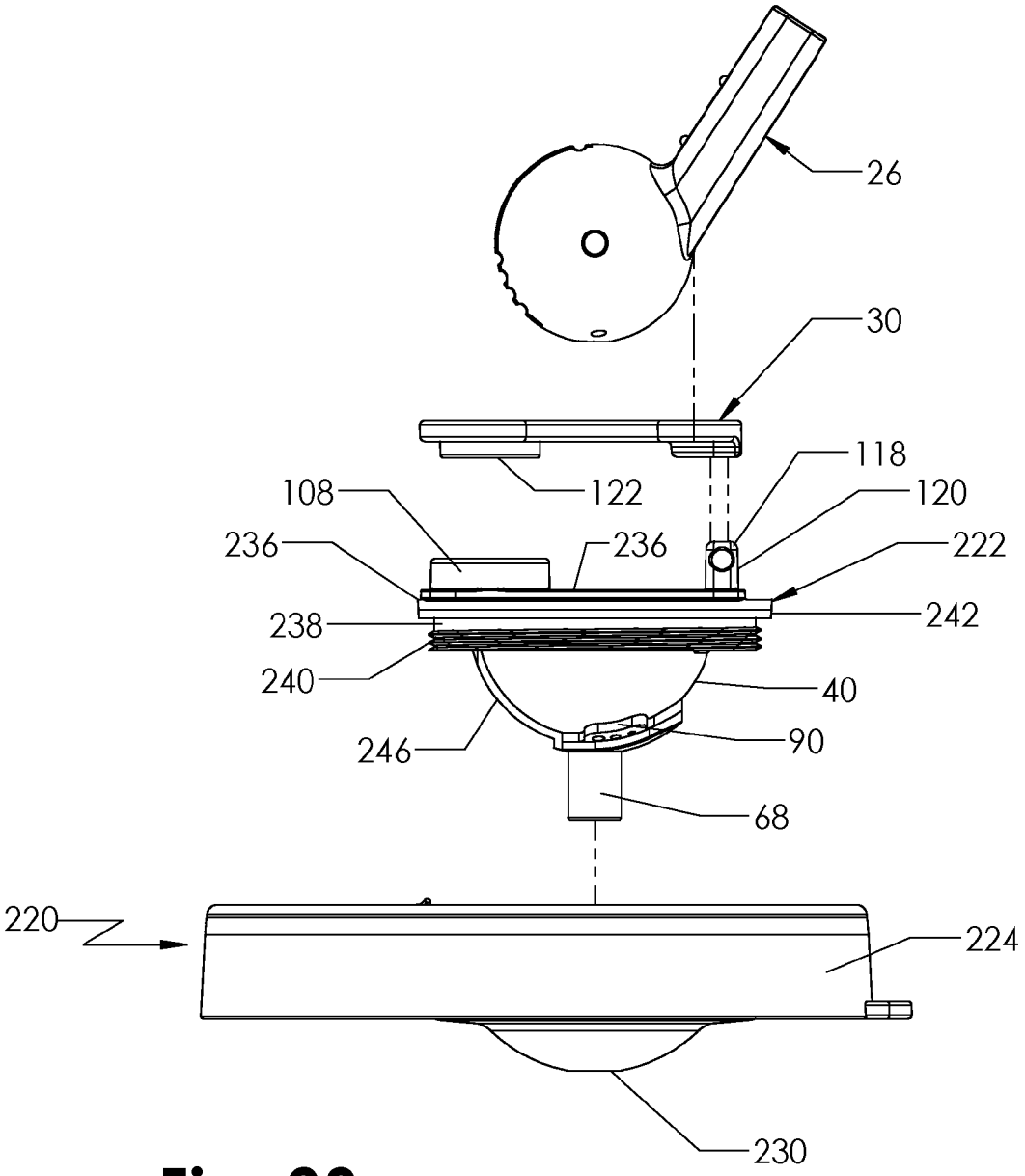
FIG. 28 is an exploded side elevation view of the embodiment of the lid assembly of FIG. 27.
Figure 29:
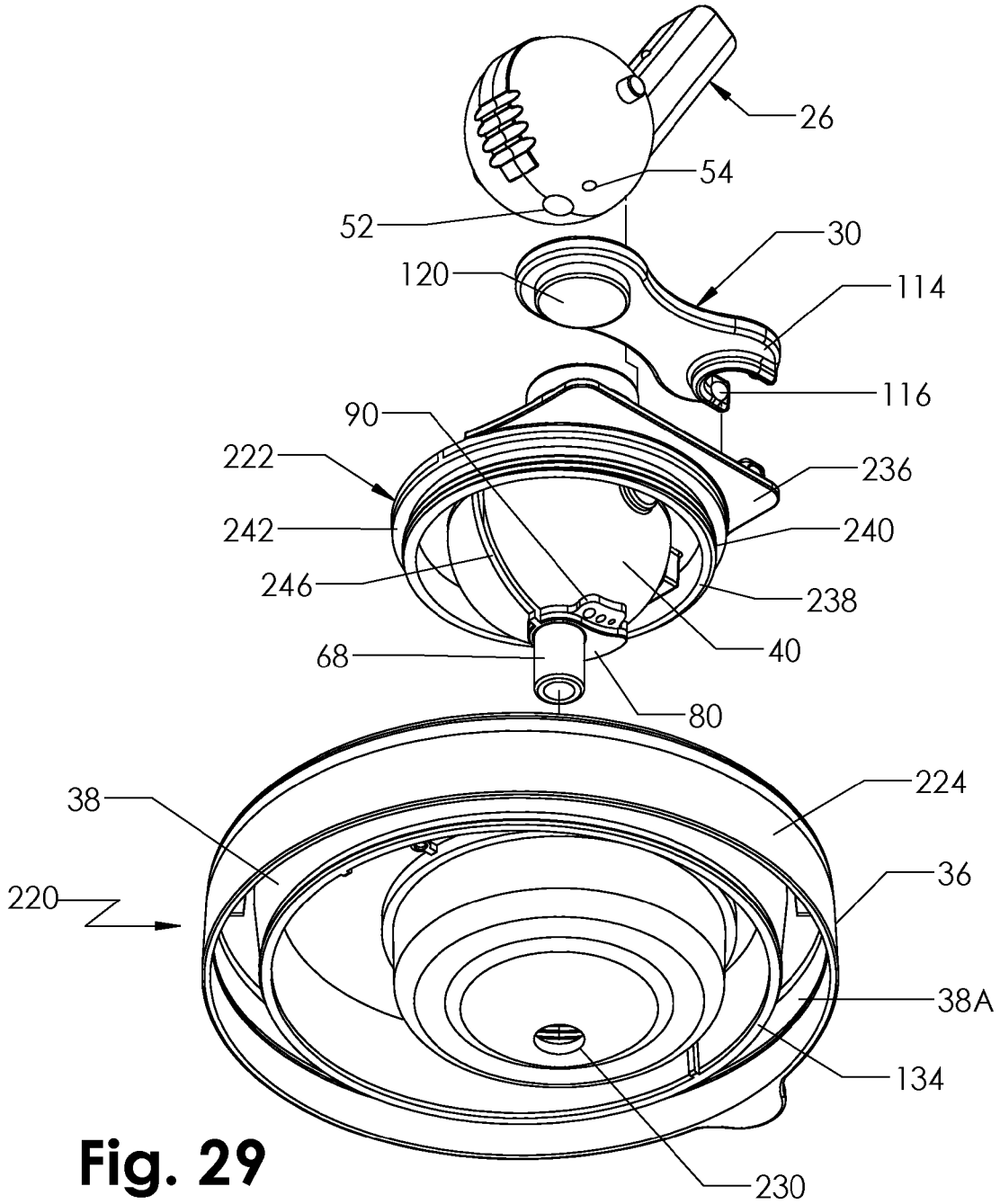
FIG. 29 is an exploded isometric of the embodiment of the lid assembly of FIG. 27 but taken from a different oblique angle.
Figure 30:
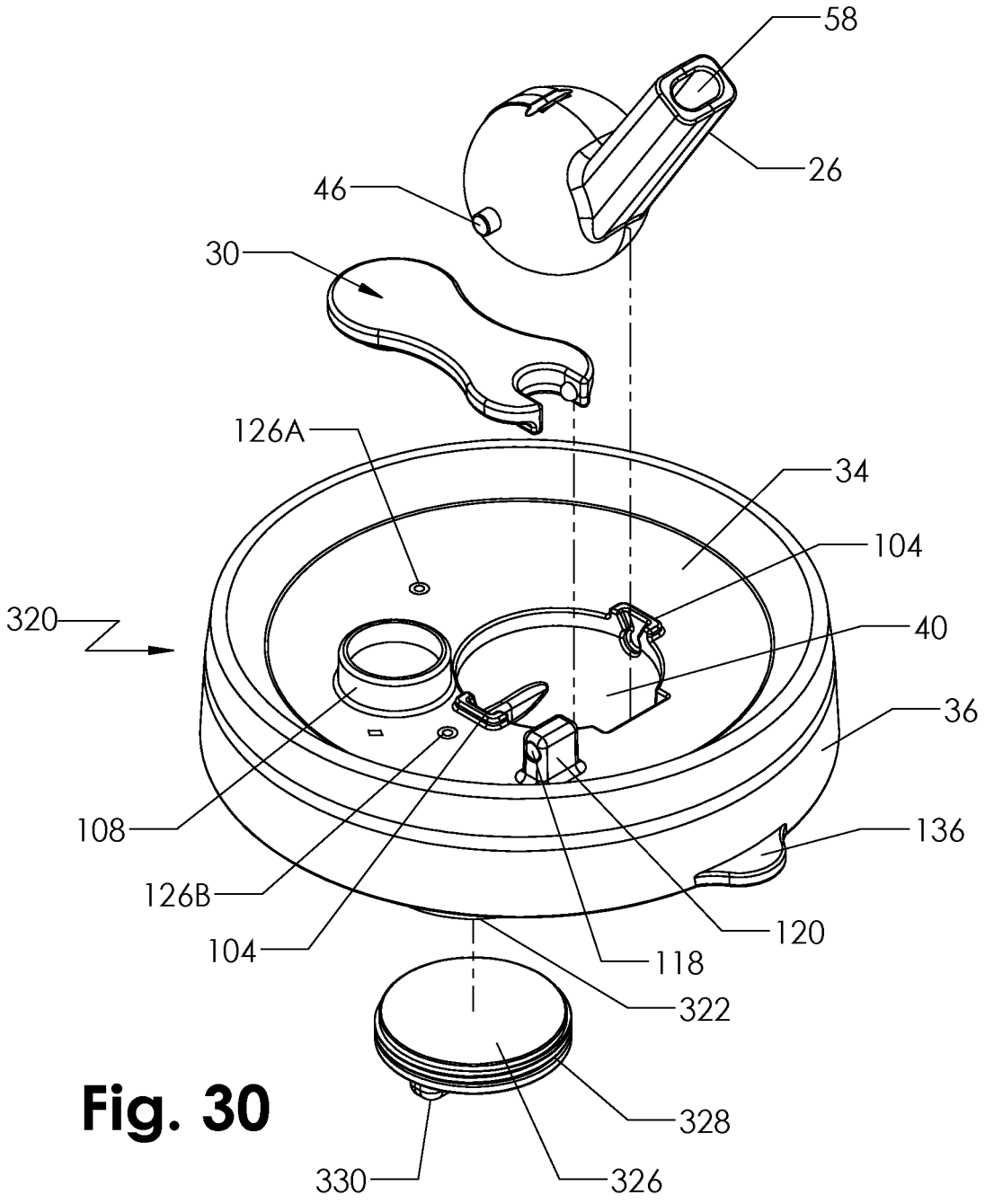
FIG. 30 is an exploded isometric view taken from an oblique angle of a third exemplary embodiment of a lid assembly constructed in accordance with this invention.
Figure 31:
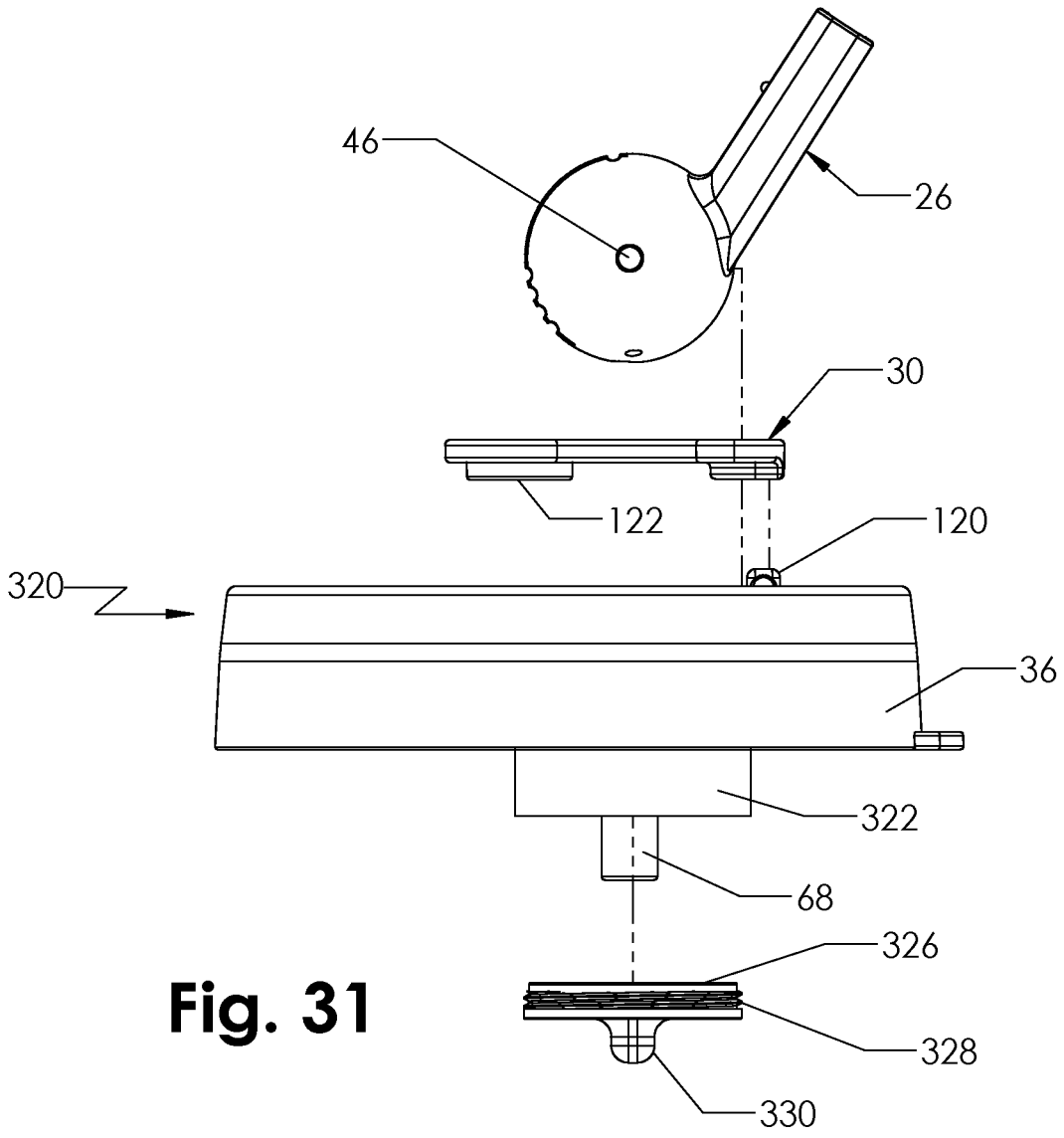
FIG. 31 is an exploded side elevation view of the embodiment of the lid assembly of FIG. 30.
Figure 32:
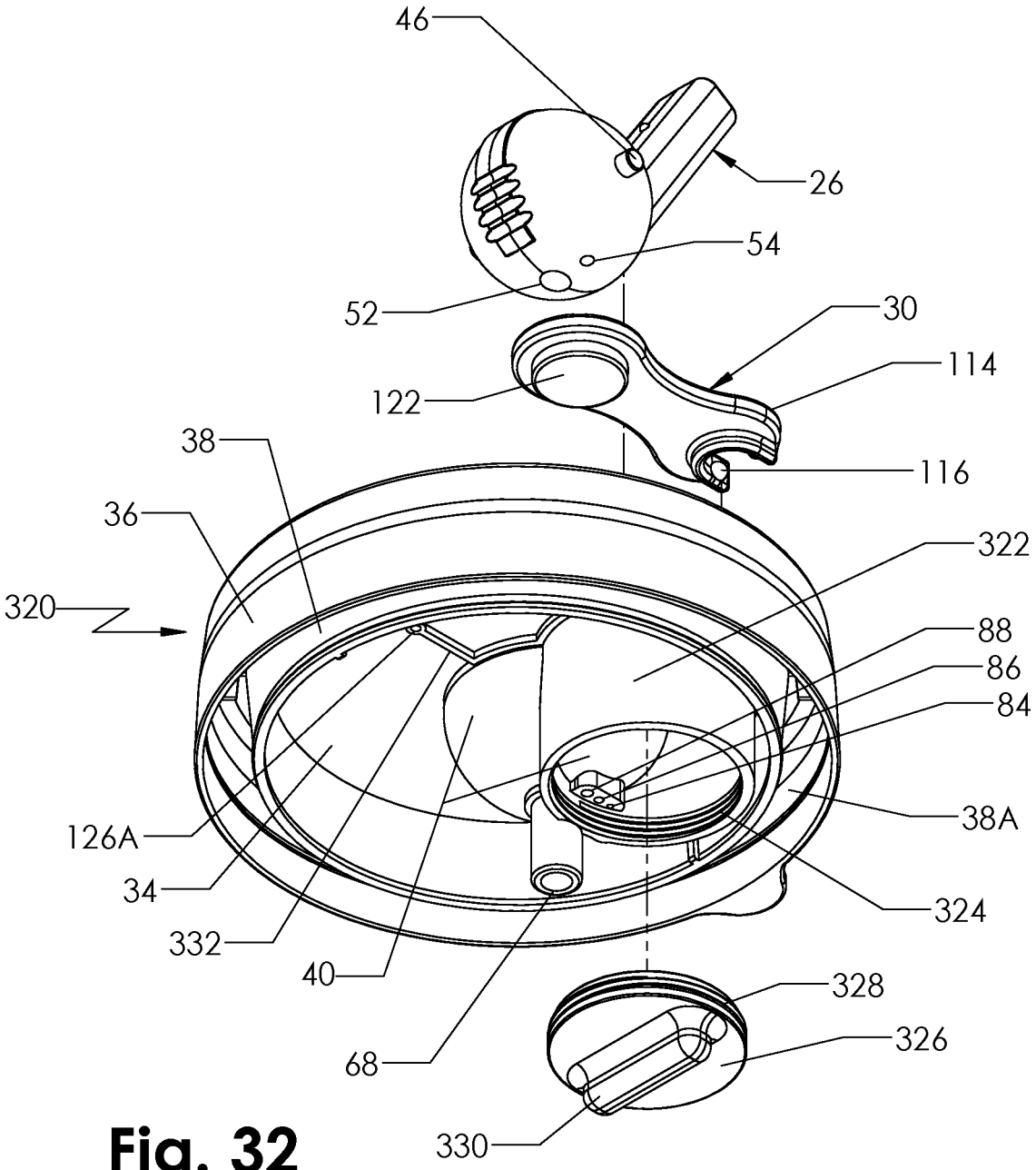
FIG. 32 is an exploded isometric of the embodiment of the lid assembly of FIG. 30 but taken from a different oblique angle.
Figure 33:
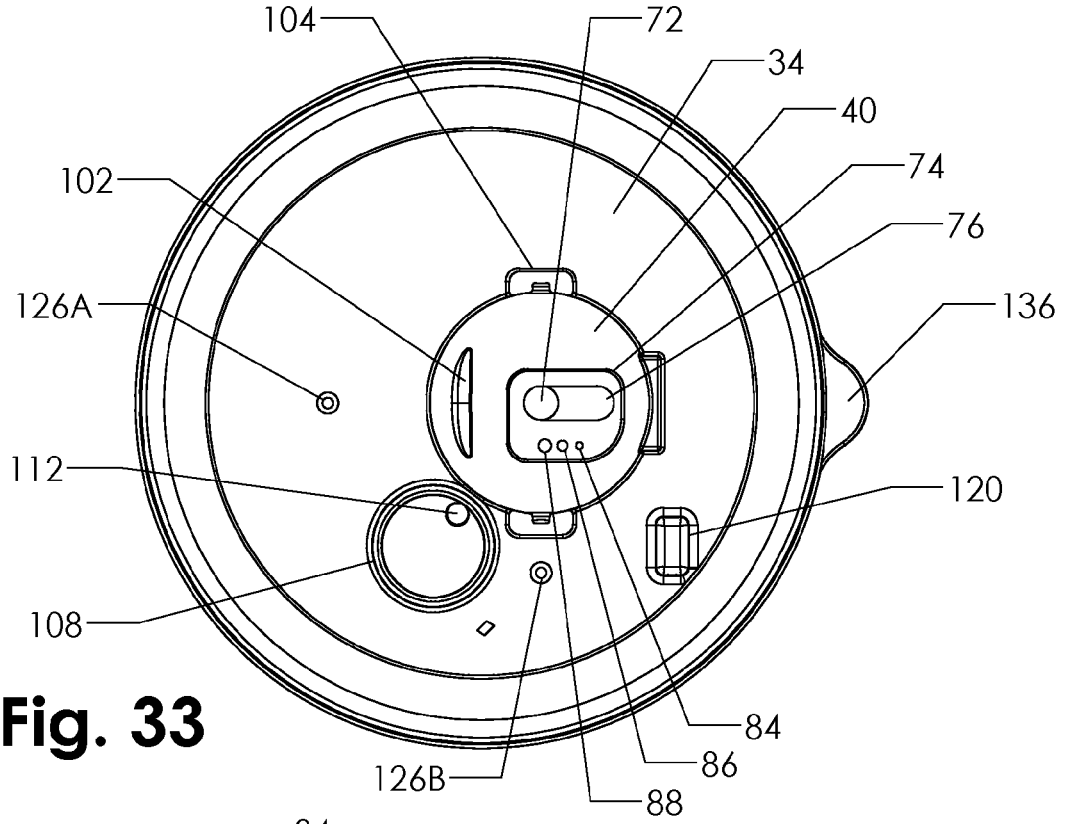
FIG. 33 is a top plan view of the lid component of the lid assembly of FIG. 30.
Figure 34:
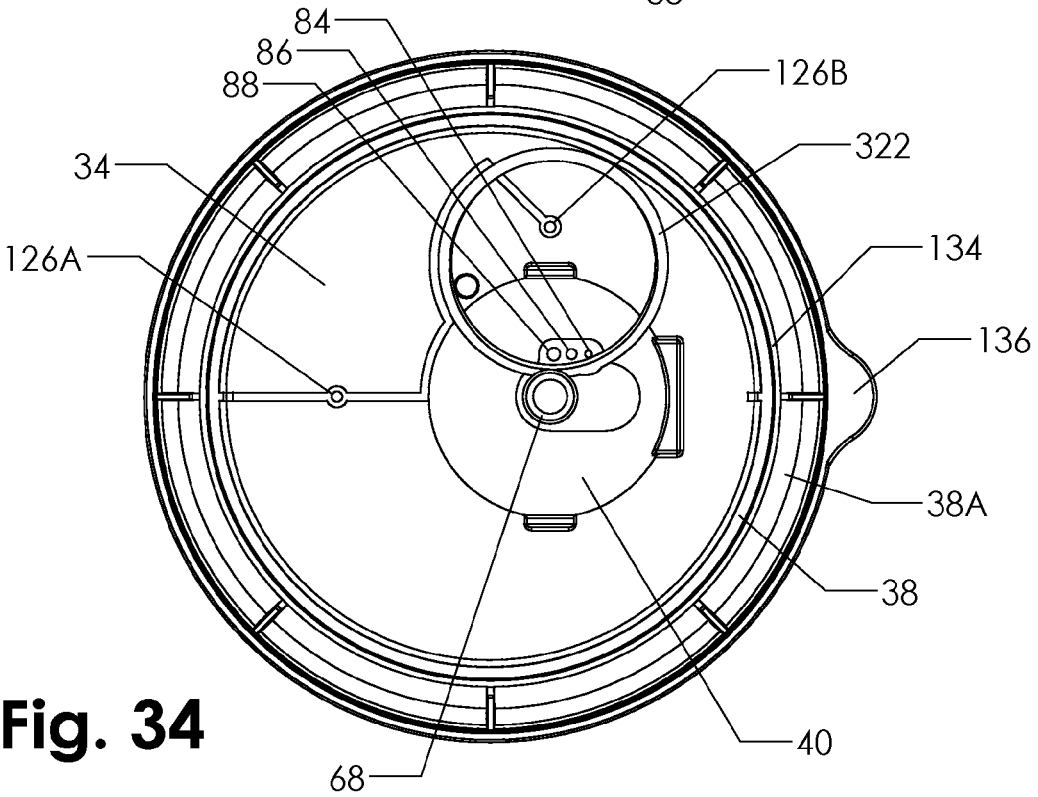
FIG. 34 is a bottom plan view of the lid component of the lid assembly of FIG. 30.
Figure 35:
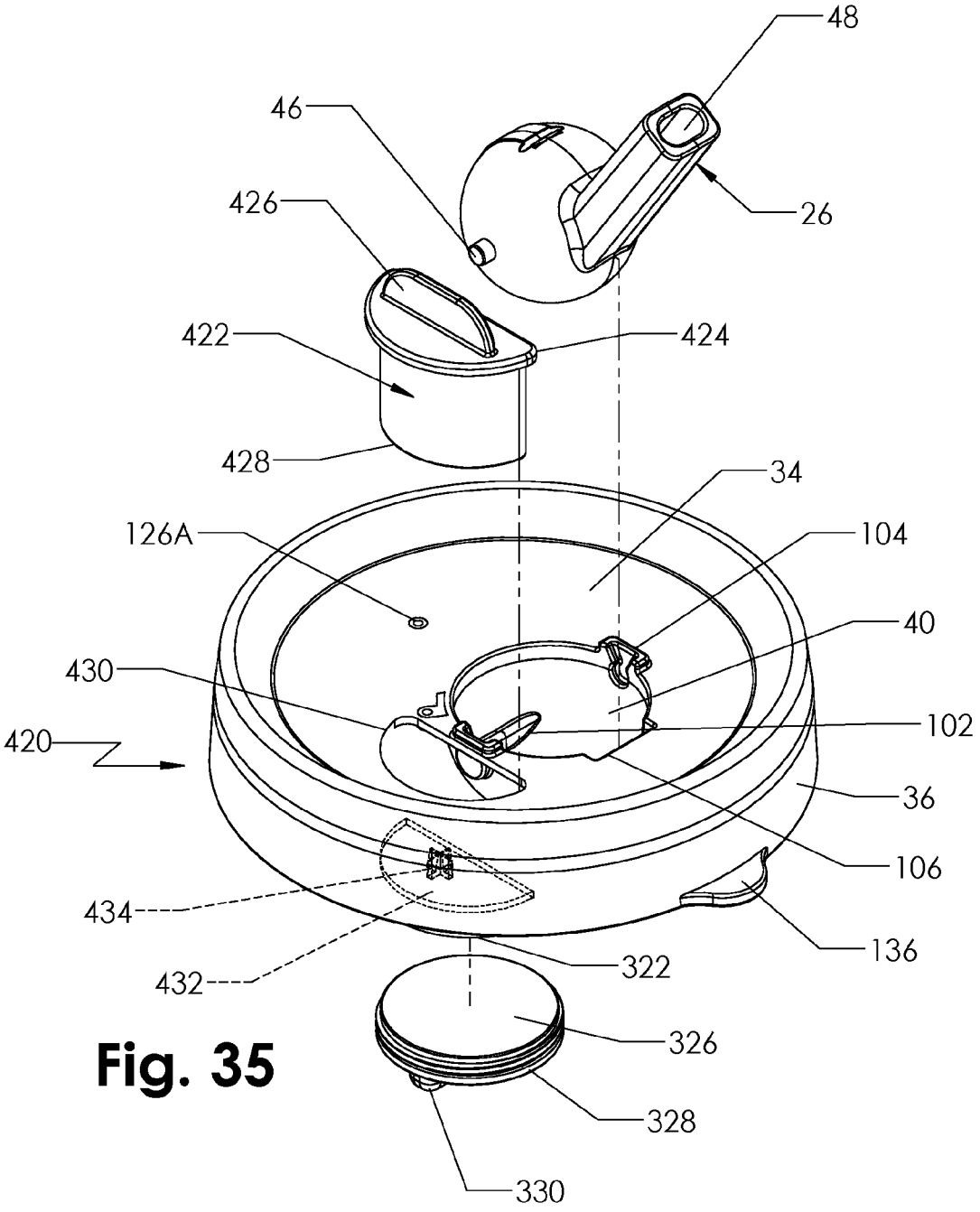
FIG. 35 is an exploded isometric view taken from an oblique angle of a fourth exemplary embodiment of a lid assembly constructed in accordance with this invention.

Turning now to FIGS. 27-29 there is shown a second exemplary embodiment of a lid assembly 220 constructed in accordance with this invention. The lid assembly 220 includes the same features as the lid assembly 20, except for the construction of the agent chamber and some associated components (to be described hereinafter). In the interest of brevity the common features of the lid assemblies 20 and 220 will be given the same reference characters and the details of their construction, arrangement and function will not be reiterated. Thus, as can be seen the lid assembly 220 includes a subassembly 222 which is arranged to be releasably secured to top wall 234 of the lid 224. In particular, the lid 224 includes a cavity 226 which includes an internal helical thread 228 at its top end. The bottom of the cavity 226 includes a central hole 230 (FIG. 29). The subassembly 222 is in the form of a threaded body which is arranged to be screwed into the cavity 226. To that end, the body includes a generally planar top wall portion 236 from which an annular wall 238 (FIG. 28) projects downward. The annular wall includes an external helical thread 240 for threaded engagement with the internal helical thread 228 of the cavity 226. The top wall 236 includes the wall portion 40 projecting downward within the interior of the annular wall 238. Like the lid assembly 20, the wall portion 40 of the lid assembly 220 forms the top wall of the agent chamber. The bottom of the wall portion 40 is in the form of the collar 68 and is arranged to fit within the hole 230 of the cavity 226 when the subassembly 220 is screwed into the cavity 226. When the subassembly is screwed into the cavity 226, the bottom of the cavity 226 forms the bottom wall of the liquid agent chamber. An elastomeric sealing ring 242 is located on the undersurface of the top wall 236 extending about the annular wall 238 to form a good liquid-tight seal between the subassembly 222 and the lid 224. With the subassembly screwed into place on the lid, a portion of the mesa 80 of the elastomeric seal 78 will form a good liquid-tight seal and the interface between the collar 68 and the hole 230. The lid 234 includes an elastomeric (e.g., TPE) member 244 having the vent hole 126A which is in fluid communication with the interior of the vessel 22 when the lid assembly 220 is mounted thereon. The vent hole 126B is located in the top wall 236 of the subassembly 222 and forms a portion of an integral sealing member 246, other portions of which form the sealing members 74 and 78. The integral sealing member 246 is formed of the same material as the integral sealing member 130, e.g., TPE. The use of a vessel with the lid assembly 220 on it is the same as that described above with reference to the lid assembly 20.

Turning now to FIGS. 30-34 there is shown a third exemplary embodiment of a lid assembly 320 constructed in accordance with this invention. The lid assembly 320 includes the same features as the lid assembly 20, except for the construction of the agent chamber. In the interest of brevity the common features of the lid assemblies 20 and 320 will be given the same reference characters and the details of their construction, arrangement and function will not be reiterated. The lid assembly 320 includes an annular sidewall 322 (FIG. 32) projecting downward from the undersurface of the top wall 34 on one side of the wall portion 40. The free or bottom end of the sidewall 322 includes an internal helical thread 324. A cap 326 of circular profile having an external helical thread 328 is screwed onto the thread of the sidewall to form the agent chamber. The cap 326 includes a handle 330 to facilitate screwing it into the threads of the sidewall 322. A portion of the undersurface of the wall portion 40 through which the agent orifices 84, 86, and 88 extend is located within the bounds of the sidewall 322 to provide access to the liquid agent within the agent chamber. The filling portal 108 is located on the top wall 34 over the sidewall 322 so that its port 112 is in fluid communication with the agent chamber, whereupon the agent chamber can be filled with the liquid agent through the filling portal. The use of a vessel with the lid assembly 320 on it is the same as that described above with reference to the lid assemblies 20 and 220. The vent holes 126A and 126B, which are in fluid communication with the interior of the vessel and the agent chamber, respectively, form portions of a unitary elastomeric, e.g., TPE member 332.

Figure 36:
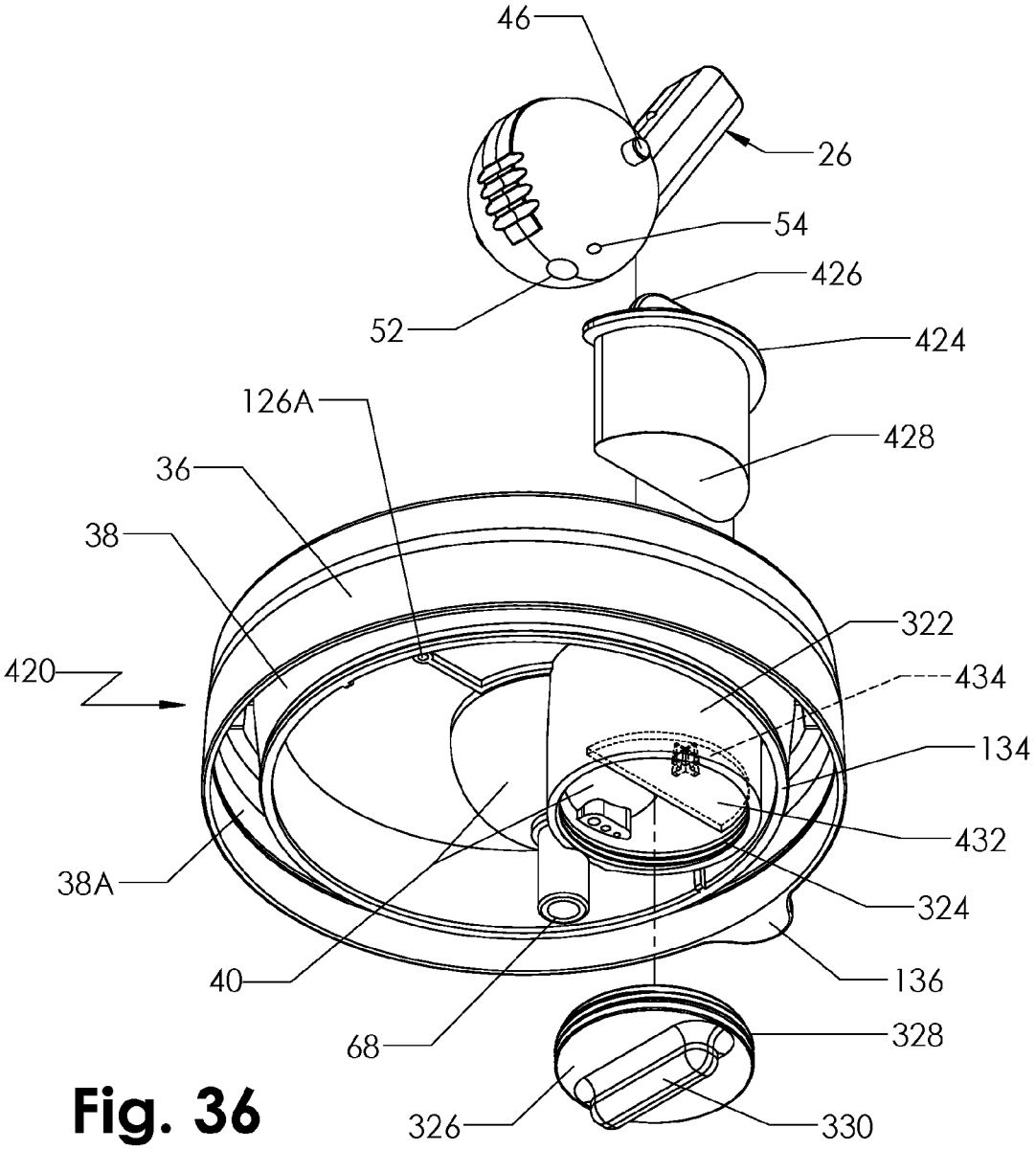
FIG. 36 is an exploded isometric of the embodiment of the lid assembly of FIG. 33 but taken from a different oblique angle.
Figure 37:
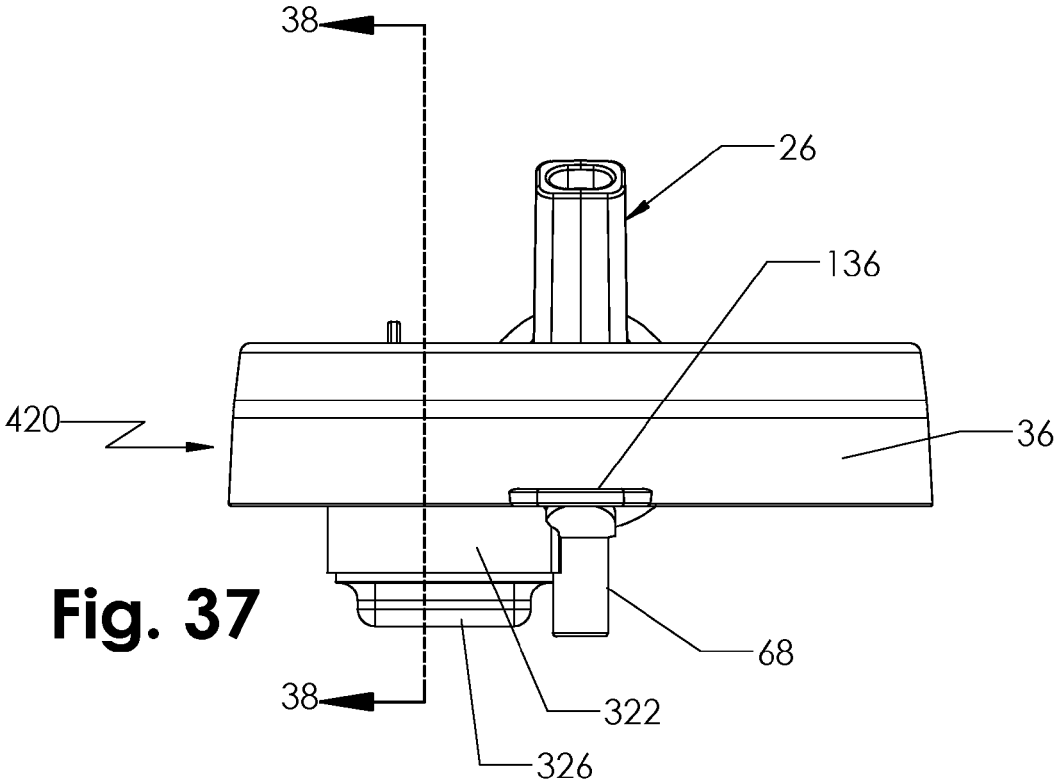
FIG. 37 is a front elevation view of the embodiment of the lid assembly of FIG. 33.
Figure 38:
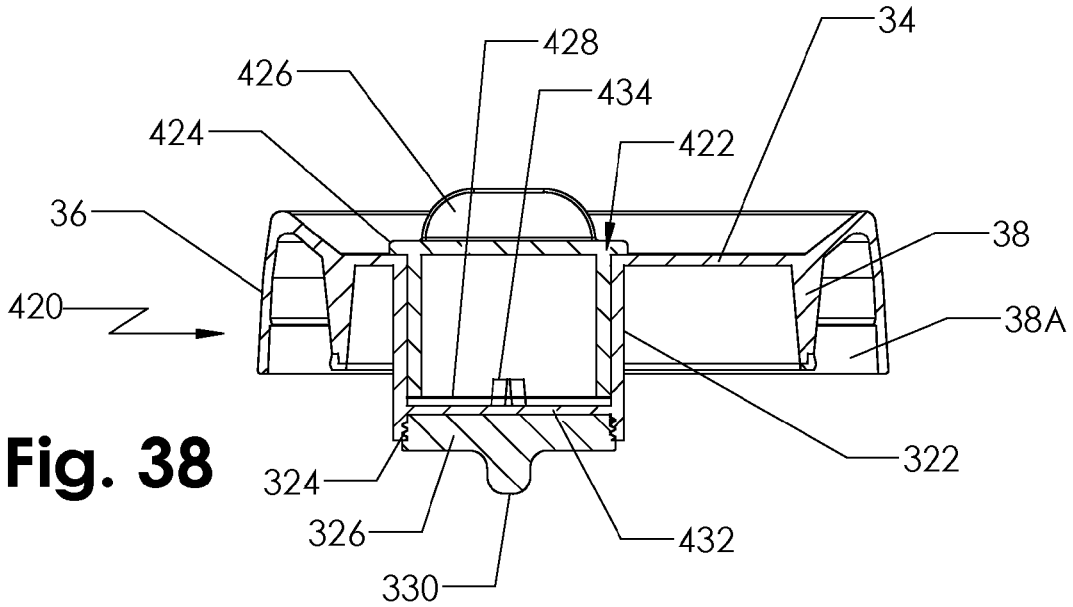
FIG. 38 is a cross sectional view of the lid assembly of the device of FIG. 33, taken along line 38-38 of FIG. 37.
Figure 39:
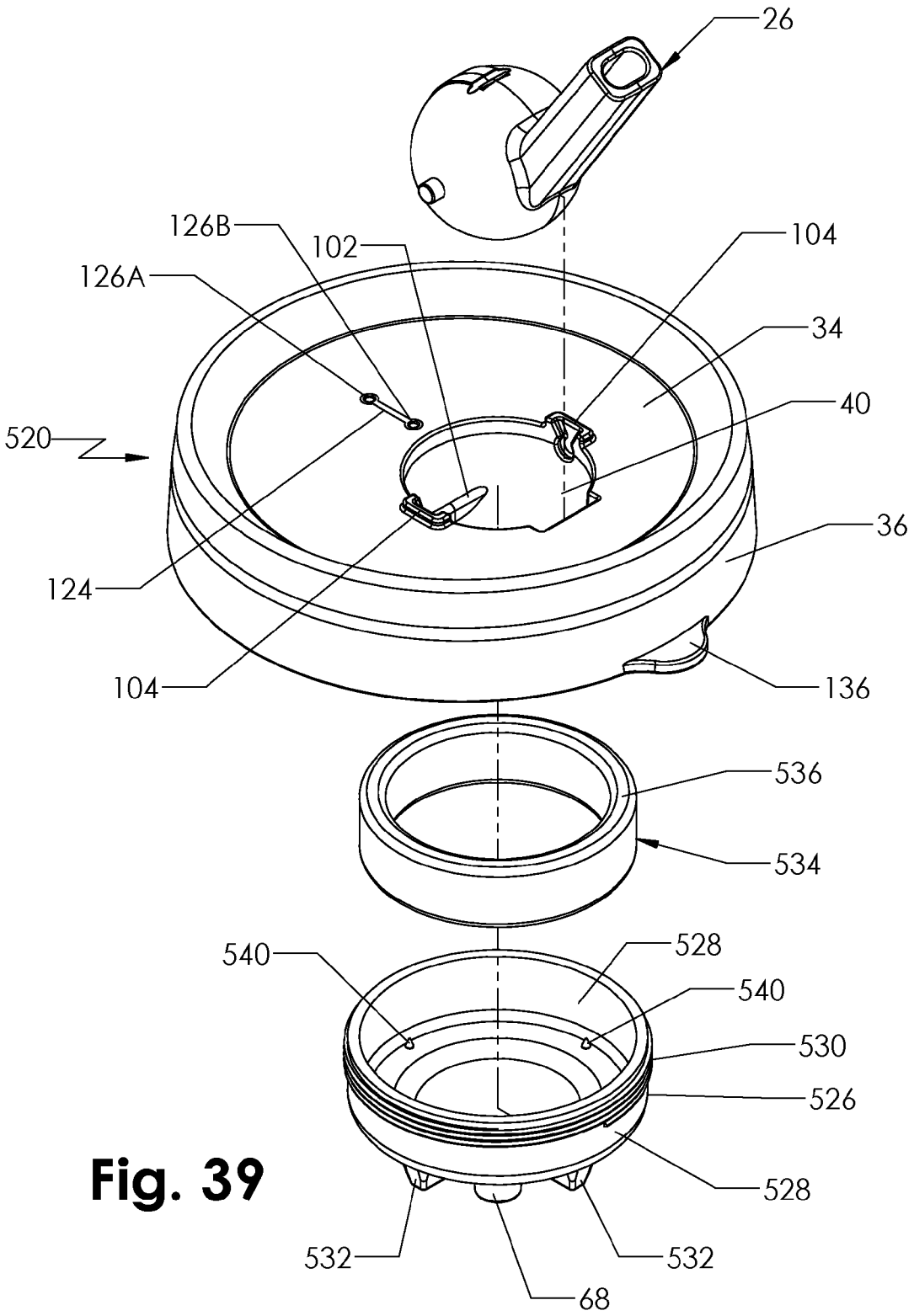
FIG. 39 is an exploded isometric view taken from an oblique angle of a fifth exemplary embodiment of a lid assembly constructed in accordance with this invention.

Turning now to FIGS. 35-38 there is shown a third exemplary embodiment of a lid assembly 420 constructed in accordance with this invention. The lid assembly 420 includes the same features as the lid assembly 320, except for the construction of the agent chamber and some associated components (to be described in detail shortly). In the interest of brevity the common features of the lid assemblies 320 and 420 will be given the same reference characters and the details of their construction, arrangement and function will not be reiterated. The lid assembly 420 includes the annular sidewall 322 (FIG. 36) and the cap 326 which together form the agent chamber of the lid assembly 420. However the agent chamber of the lid assembly 420 does not include a filling portal like that of lid assembly 320. Instead it makes use of a canister or cartridge 422 holding the liquid agent therein. The canister or cartridge 422 is a hollow body of half-moon shape when viewed from the top, with the liquid agent located within the body. The top wall 424 of the canister or cartridge is of the same half-moon shape as the body but extends outward beyond the sides of the body to form a flange. A handle 426 projects upward from the top wall to enable a user to readily pick up the canister or cartridge. The bottom wall 428 (FIG. 38) of the canister or cartridge is frangible. The canister or cartridge is configured to be inserted within a half-moon shaped opening 430 in the top wall 32 of the lid, with the periphery of the flanged top 424 extending over the periphery of the opening 430 to suspend the canister or cartridge in place with respect to the top wall of the lid and within the agent chamber. As best seen in FIG. 36, the annular sidewall 322 includes an intermediate, semi-circularly shaped wall portion 432 located just above the internal threads 324 of the sidewall 322. The wall portion 432 includes a pointed piercing member 434 projecting upward therefrom. The height of the body of the canister or cartridge 422 is such that when the canister or cartridge is suspended by the engagement of its flanged top 424 with the top wall 34 of the lid, the piercing member 434 will have pierced through the frangible bottom wall 428 of the cartridge or canister to release the liquid contents of the canister or cartridge into the agent chamber and hence into fluid communication with the metering orifices 84, 86 and 88. Once that has been accomplished the vessel 22 with the lid assembly 420 is ready for use. The use of a vessel with the lid assembly 420 on it is the same as that described above with reference to the lid assemblies 20, 220 and 320.

Figure 40:
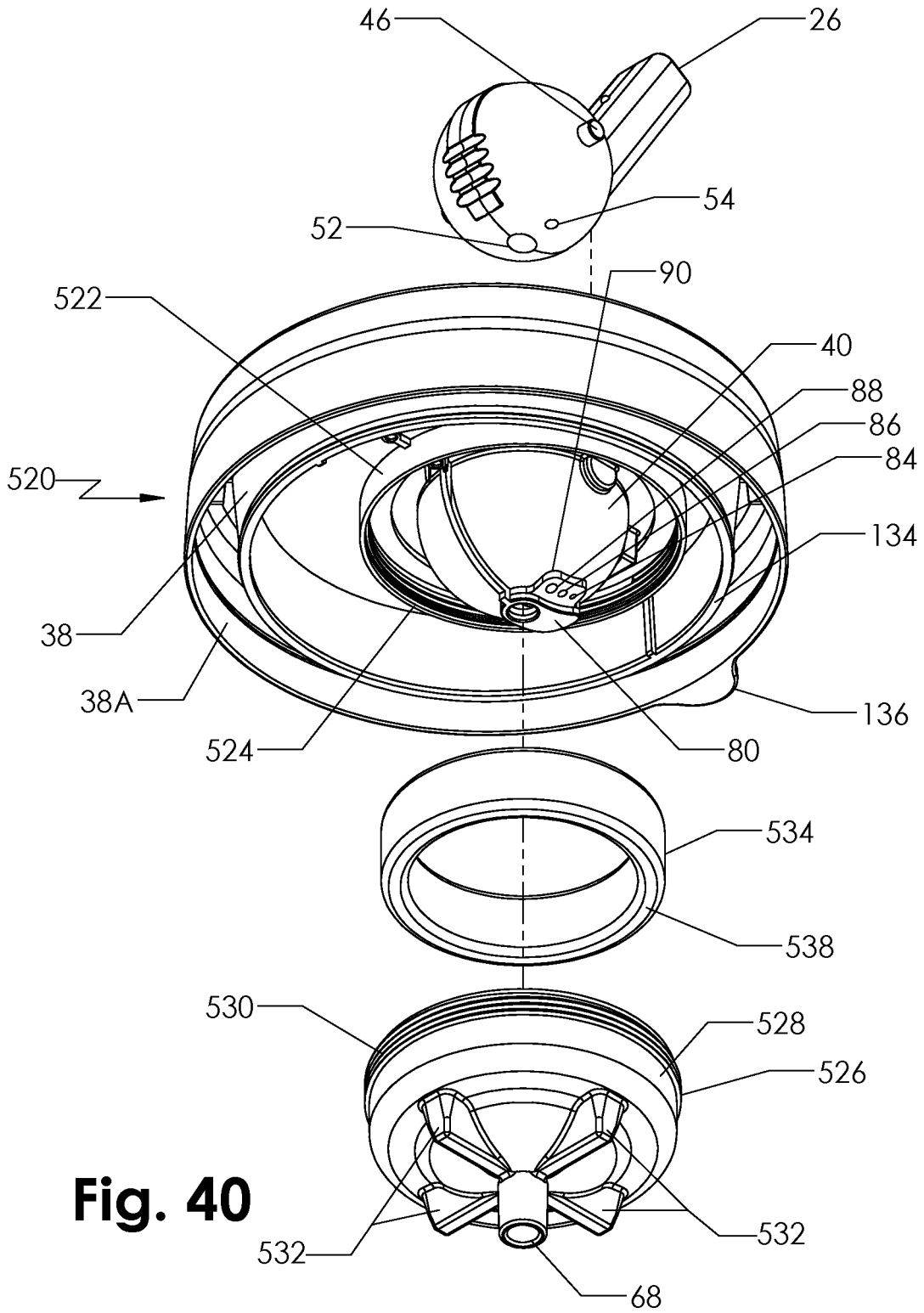
FIG. 40 is an exploded isometric of the embodiment of the lid assembly of FIG. 37 but taken from a different oblique angle.
Figure 41:
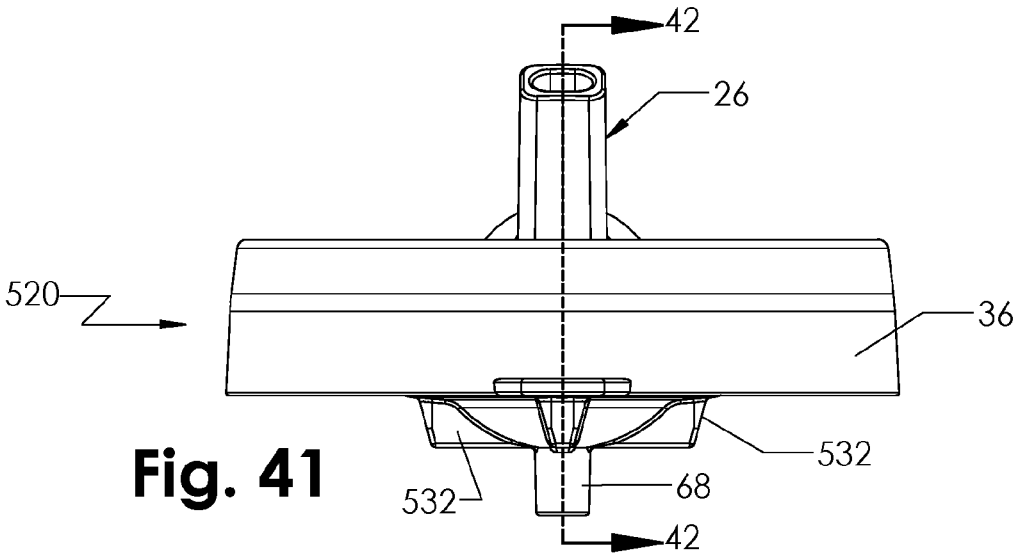
FIG. 41 is a front elevation view of the embodiment of the lid assembly of FIG. 37.
Figure 42:
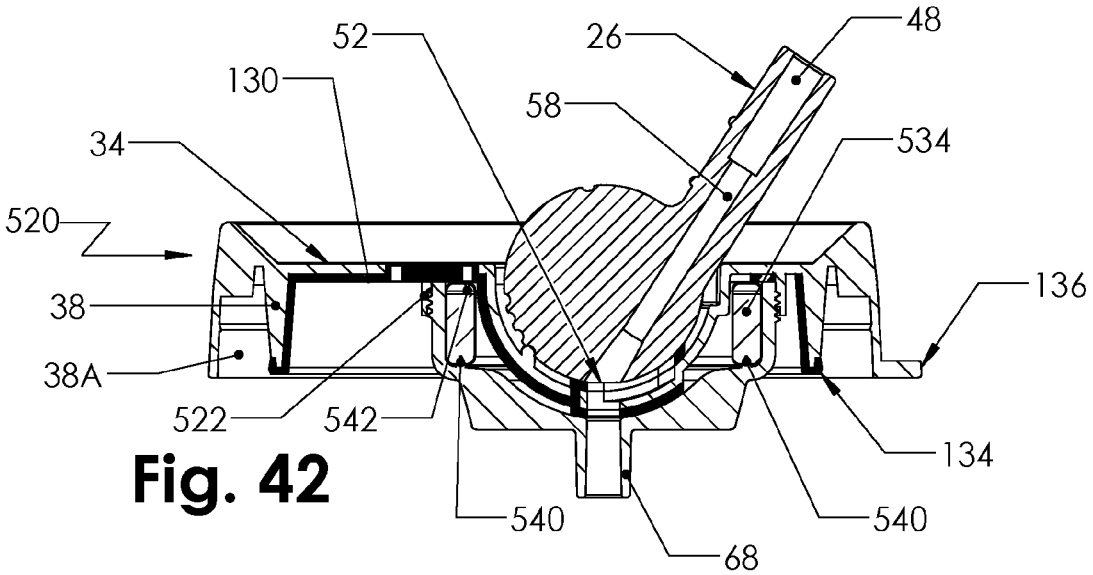
FIG. 42 is a cross sectional view of the lid assembly of the device of FIG. 39, taken along line 42-42 of FIG. 41.

Turning now to FIGS. 39-42 there is shown a fourth exemplary embodiment of a lid assembly 520 constructed in accordance with this invention. The lid assembly 520 includes the same features as the lid assembly 420, except for the construction of the agent chamber and the canister or cartridge holding the liquid agent. In the interest of brevity the common features of the lid assemblies 420 and 520 will be given the same reference characters and the details of their construction, arrangement and function will not be reiterated. The lid assembly 520 includes an annular sidewall 522 which extends downward from the underside of the lid's top wall 34 and includes an internal helical thread 524 located adjacent the bottom of the sidewall. A cup-shaped base 526 which is of circular profile having a sidewall 528 which includes an external helical thread 530 is screwed onto the internal helical thread 524 on the annular wall 522. The collar 68 projects downward from the center of the bottom wall of the cup-shaped base. The bottom wall of the cup-shaped base includes four radially projecting tabs 532 (FIG. 40), which act as finger grips to facilitate the screwing of the cup-shaped base onto the annular sidewall 522. Together the cup-shaped base and the annular sidewall define the agent chamber of the lid assembly 520. That chamber is configured to receive a canister or cartridge 534 holding the liquid agent. The canister or cartridge 534 is an annular member of circular profile having a frangible top wall 536 (FIG. 39) and a frangible bottom wall 538 (FIG. 40). The outer diameter of the canister or cartridge is just slightly less than the inside diameter of the sidewall 528 so that it fits within the agent chamber. The inner surface bottom wall of the cup-shaped base close to the sidewall 528 includes plural, e.g., four, equidistantly spaced piercing points 540 projecting upward. The undersurface of the top wall 34 of the lid just radially inward of the sidewall 522 includes at least one downwardly projecting piercing point 542 (FIG. 42). The height of the canister or cartridge 534 is such that when the cup-shaped base 526 is screwed onto the annular sidewall 522, the piercing points 540 will pierce the bottom wall 538 of the canister or cartridge and the at least one piercing point 544 will pierce the top wall 536 of the canister or cartridge thereby releasing the liquid agent into the agent chamber and hence in fluid communication with the metering orifices 84, 86 and 88. Once that has been accomplished the vessel 22 with the lid assembly 520 is ready for use. The use of a vessel with the lid assembly 520 on it is the same as that described above with reference to the lid assemblies 20, 220, 320 and 420.

It should be pointed out at this juncture that the liquid agent that is used by the subject invention to make the mixed liquid e.g., a flavored beverage, need not be initially in liquid form for use in a device constructed in accordance with this invention. Thus, the subject invention contemplates that some ingredient(s), dry or a slurry or a gel or other non-liquid form and from which the liquid agent can be made, can be provided into a device constructed in accordance with this invention, and then made into the liquid agent therein. Then that liquid agent can be provided to the agent chamber. For example, a canister or cartridge containing a dry, e.g., granular agent, which when mixed with water or some other liquid produces the liquid agent, can be disposed in a chamber in a lid assembly constructed in accordance with this invention and then water or some other liquid introduced into that chamber to produce the liquid agent within that chamber, whereupon the liquid agent can be conveyed into the agent chamber. In fact the chamber for producing the liquid agent may in fact be the liquid agent chamber.

As should be appreciated by those skilled in the art, the subject invention provides numerous advantages over prior art devices. For example, it enables one to readily configure the lid assembly to provide a desired intensity or concentration of the liquid agent in a base liquid. Moreover, the mixing is accomplished in the lid assembly, not in the vessel itself. Thus, with one fill of a base liquid in the vessel and an one fill of the liquid agent in the agent chamber, a user can use the invention at different times, each time selecting a desired concentration of the mixed liquid to be delivered. In the exemplary embodiments the concentration of the liquid agent is selectable from one of three discrete concentrations, i.e., low, medium and high. However, those embodiments are merely exemplary of various modifications that can be made to the invention. Thus, the subject invention contemplates providing lid assemblies or other devices configured for providing only a single concentration, two discrete concentrations or three or more discrete concentrations. Moreover the lid assemblies or other devices constructed in accordance with the invention enable one to select a desired liquid agent concentration without requiring any one-way valve or similar mechanism to prevent leakage of liquid agent into base liquid in the vessel. Furthermore, as pointed out above, tolerances between the spout and the agent chamber are unimportant, so long as there is a material of sufficient durometer to form seals surrounding the interface of the ports of the spout and the metering orifices of the agent chamber to thereby provide a continuous path for the liquid agent to flow while preventing its leakage out of that interface. Further still, because of the double-barreled spout the flavoring agent and the base liquid are not mixed until they reach the mixing chamber which is at a location immediately adjacent the user's mouth and remote from the interior of the vessel holding the base liquid the danger of any backflow of the liquid agent into the base liquid is minimized. Further yet, the lid assemblies or other devices constructed in accordance with this invention will work on a vessel irrespective of the orientation of the vessel when the user drinks from it. Thus, the user can drink from the vessel holding it at any orientation, not merely at an orientation above horizontal. All that is required is to hold the vessel at any comfortable orientation, pivot the spout to establish the desired mixture concentration and then suck on the spout to draw the liquid into the mouth. In fact, the construction of the subject invention enables equal flow at all vessel orientations. The lid assemblies and other devices constructed in accordance with this invention also have the advantage of a relatively low parts count, and their construction enables them to be easily disassembled for cleaning and then reassembled for use. Further yet, lid assemblies and other devices constructed in accordance with this invention can make use of a very simple and inexpensive canister or cartridge holding the liquid agent and need not include any valve or other metering mechanism, since the metering to establish the amount of the liquid agent concentration is achieved independent of the canister or cartridge, i.e., it is established by the cooperation of the spout's inlet ports and the agent chamber's metering orifices. Lastly, it should be pointed out that while the above examples of subject invention has been described in the form of a lid assembly, it should be clear that the subject invention also contemplates that the lid assembly or other device can form a part of the drinking vessel itself.

Without further elaboration the foregoing will so fully illustrate our invention that others may, by applying current or future knowledge, adopt the same for use under various conditions of service.

We claim:

1. A device for use with a vessel in which a base liquid is located, the vessel including an interior and a bottom, said device being configured for dispensing a portion of a liquid agent into a portion of the base liquid drawn from the vessel, said device comprising:

a) a spout comprising a mixing space located within said spout and having an agent inlet port and a base liquid inlet port, said agent inlet port and said base liquid inlet port being in communication with said mixing space, said spout being selectively movable to any one of a first position, a second position, and a third position;

b) an agent chamber coupled to said spout, said agent chamber being configured for holding the liquid agent therein and comprising a base liquid metering orifice and a first agent metering orifice, said base liquid metering orifice being isolated from said base liquid inlet port and said agent inlet port being isolated from said first agent metering orifice when said spout is in said first position;

c) a conduit coupled to said agent chamber and having a portion configured to be located adjacent the bottom of the vessel, said conduit being in communication with said base liquid inlet port via said base liquid metering orifice, said agent inlet port being isolated from said first agent metering orifice when said spout is in said second position, whereupon the base liquid from the vessel can to be drawn through said base liquid metering orifice and said base liquid inlet port into said mixing space, said first agent metering orifice being in communication with said agent inlet port and said base liquid inlet port being in communication with said conduit via said base liquid metering orifice when said spout is in said third position to enable a portion of the base liquid from the vessel to be drawn through the base liquid metering orifice and said base liquid port into said mixing space and to enable a portion of the liquid agent within said agent chamber to be drawn through said first agent metering orifice and said agent inlet port into said mixing space for mixing with the base liquid in said mixing space.

2. The device of claim 1 wherein said wall portion of said agent chamber has a second agent metering orifice therein, said second agent metering orifice being of a different size than said first agent metering orifice, said spout also being selectively moveable with respect to said agent chamber to a fourth position, said second agent metering orifice being in communication with said agent inlet port and said base inlet port being in communication with said conduit via said base liquid orifice when said spout is in said fourth position to enable the portion of the base liquid from the vessel to be drawn through said base liquid orifice and said base liquid inlet port into said mixing chamber and to enable the portion of the liquid agent within said agent chamber to be drawn through said second agent metering orifice and said agent inlet port into said mixing space for mixing with the base liquid in said mixing space.

3. The device of claim 2 wherein said wall portion of said agent chamber has a third agent metering orifice therein, said third agent metering orifice being of a different size than said first and second agent metering orifices, said spout also being selectively moveable with respect to said agent chamber to a fifth position, said third metering orifice being in communication with said agent inlet port and said base liquid inlet port being in communication with said conduit via said base liquid orifice when said spout is in said fifth position to enable the portion of the base liquid from the vessel to be drawn through said base liquid orifice and said base liquid inlet port into said mixing chamber and to enable a portion of the liquid agent within said agent chamber to be drawn through said third agent metering orifice and said agent inlet port into said mixing space for mixing with the base liquid in said mixing space.

4. The device of claim 1 wherein said spout comprises an agent passageway and a base liquid passageway, said passageways being separate from each other and merging together at said mixing space, said base liquid inlet port forming a portion of said base liquid passageway, and said agent inlet port forming a portion of said agent passageway.

5. The device of claim 1 wherein said first agent metering orifice has a first seal surrounding said first agent metering orifice to form a leak-proof interface between said first agent metering orifice and said agent inlet port when said spout is in said third position.

6. The device of claim 2 wherein said first agent metering orifice has a first seal surrounding said first agent metering orifice to form a first leak-proof interface between said first agent metering orifice and said agent inlet port when said spout is in said third position and wherein said second agent metering orifice has a second seal surrounding said second agent metering orifice to form a second leak-proof interface between said second agent metering orifice and said agent inlet port when said spout is in said fourth position.

7. The device of claim 6 wherein said first, second and third seals are formed by one integral member.

8. The device of claim 1 wherein said spout is pivotably mounted with respect to said agent chamber.

9. The device of claim 1 wherein said device includes a detent mechanism for holding said spout in each of said first, second and third positions.

10. The device of claim 1, wherein said device comprises a lid assembly for releasable securement to the vessel.

11. The device of claim 1 wherein said device comprises two vent holes, a first one of said two vent holes being in fluid communication with the interior of the vessel and a second one of said two vent holes being in fluid communication with said interior of said agent chamber.

12. The device of claim 11 wherein said movable spout includes the two projections, each of said projections being configured to seal a respect of said vent holes when said spout is in said first position.

13. The device of claim 1 wherein said device additionally comprises a canister or cartridge containing the liquid agent, said canister or cartridge being configured for disposition within said agent chamber.

14. The device of claim 13 wherein said canister or cartridge is frangible and configured to rupture within said agent chamber to release the liquid agent into said agent chamber.

15. The device of claim 1 wherein said spout is configured to enable a user of said device to suck on the spout to draw the liquid agent and the base liquid to said mixing space.

16. A method for dispensing either a base liquid or a mixture of a base liquid and a liquid agent into the mouth of a user, said method comprising:

a) providing a vessel configured for holding the base liquid therein and comprising a dispensing device coupled to said vessel and having a spout, an agent chamber, a conduit, a base liquid inlet port, and an agent inlet port, said conduit being in fluid communication with said base liquid in said vessel, said agent chamber being configured for holding a liquid agent therein and comprising a first agent metering orifice, said dispensing device being configured so that a portion thereof can be moved to any one of a first, second and third positions, said base liquid inlet port being isolated from said base liquid orifice and said agent inlet port being isolated from said first agent metering orifice when said portion of said device is in said first position, said base liquid inlet port being in communication with said conduit via said base liquid orifice and said agent inlet port being isolated from said first agent metering orifice when said portion of said device is in said second position, said first agent metering orifice being in communication with said agent inlet port and said base liquid inlet port being in communication with said conduit via said base liquid orifice when said portion of said device is in said third position;

b) moving said portion of said device from said first position to either said second position or said third position; and c) sucking on said spout by the user when said device is in either said second or third position, whereupon if said device is in said second position the sucking on said spout draws a portion of the base liquid into a mouth of the user and if the device is in said third position the sucking on said spout draws a portion of the base liquid and also draws a portion of the liquid agent form a mixture and dispense the mixture into the mouth of the user.

17. The method of claim 16 wherein said portion of said device which is moved is said spout.

18. The method of claim 16 wherein after said portion of said device has been moved to either the second or third position it is moved back to said first position.

19. The method of claim 16 wherein said dispensing device comprises a lid for releasable securement to said vessel and wherein said spout is pivotably mounted on said lid for pivoting movement to said first, second and third positions.

20. The method of claim 16 wherein the base liquid is water and the liquid agent is a flavoring agent.

* * * * *